US010245503B2

(12) United States Patent
Heasman

(10) Patent No.: US 10,245,503 B2
(45) Date of Patent: Apr. 2, 2019

(54) APPARATUS FOR PLAYING A GAME

(71) Applicant: Murray Heasman, Caherkirky (IE)

(72) Inventor: Murray Heasman, Caherkirky (IE)

( * ) Notice: Subject to any disclaimer, the term of this patent is extended or adjusted under 35 U.S.C. 154(b) by 0 days.

(21) Appl. No.: 15/551,593

(22) PCT Filed: Feb. 15, 2016

(86) PCT No.: PCT/EP2016/053161
§ 371 (c)(1),
(2) Date: Aug. 16, 2017

(87) PCT Pub. No.: WO2016/131768
PCT Pub. Date: Aug. 25, 2016

(65) Prior Publication Data

US 2018/0036631 A1 Feb. 8, 2018

(30) Foreign Application Priority Data

Feb. 17, 2015 (IE) ..... S2015/0039

(51) Int. Cl.
*A63F 9/08* (2006.01)
*A63H 33/08* (2006.01)
*A63F 9/12* (2006.01)

(52) U.S. Cl.
CPC ..... *A63F 9/0826* (2013.01); *A63F 9/0876* (2013.01); *A63F 9/1208* (2013.01); *A63H 33/086* (2013.01); *A63F 2009/122* (2013.01)

(58) Field of Classification Search
CPC ..... A63F 9/10; A63F 9/12
USPC ..... 273/157 R
See application file for complete search history.

(56) References Cited

U.S. PATENT DOCUMENTS 3,648,404 A * 3/1972 Ogsbury ..... A63H 33/102 403/176
3,703,304 A * 11/1972 Losee ..... F16B 15/0046 403/232.1
3,704,892 A * 12/1972 Moravick ..... A63F 9/12 206/315.1
3,728,800 A * 4/1973 Magram ..... G09B 1/36 434/171
3,777,430 A * 12/1973 Tischuk ..... E04C 2/292 52/309.9
3,810,703 A * 5/1974 Pasbrig ..... E04G 7/02 403/324

(Continued)

FOREIGN PATENT DOCUMENTS

EP 1162400 A2 12/2001
FR 1195407 A1 11/1959

(Continued)

*Primary Examiner* — John E Simms, Jr.
*Assistant Examiner* — Dolores Collins
(74) *Attorney, Agent, or Firm* — Mitchell Law PLLC; Matthew W. Mitchell

(57) ABSTRACT

An apparatus for playing a game comprises a three dimensional structure assembled from a plurality of interconnectable and disengageable construction elements. Each construction element is a shaped elongate body piece with two end mating faces or surfaces. Each mating surface has a male or female connector or two female orifices plus a four way male connector to enable each construction element to connect to and disengage other like construction elements. The interconnection between two contacting faces or surfaces is allowable in one orientation only.

13 Claims, 47 Drawing Sheets

(56) References Cited

Figure 1I:
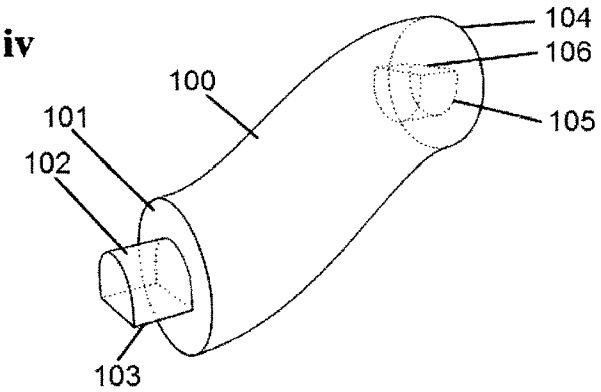
Figure 1I:
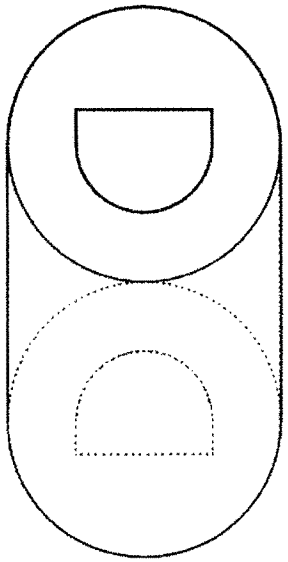
Figure 1I:
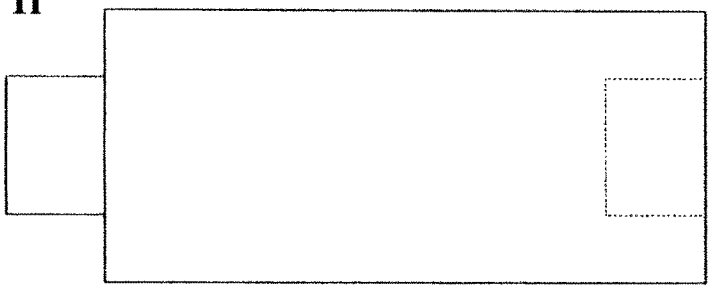
Figure 1I:
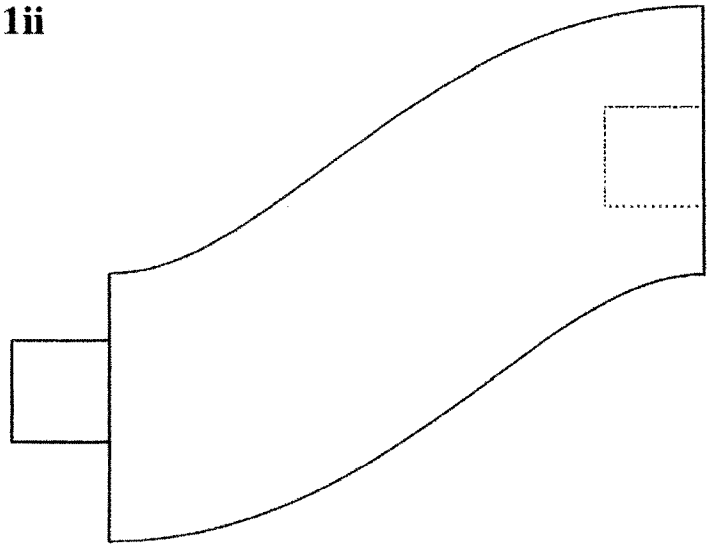
Figure 2I:
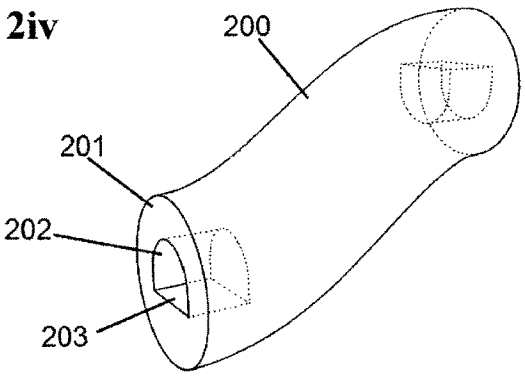
Figure 2I:
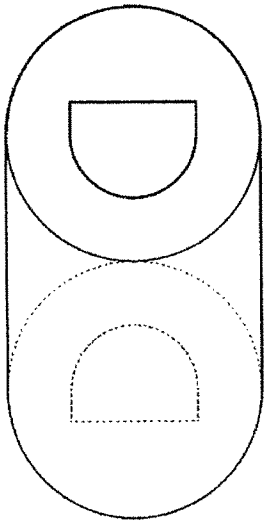
Figure 2I:
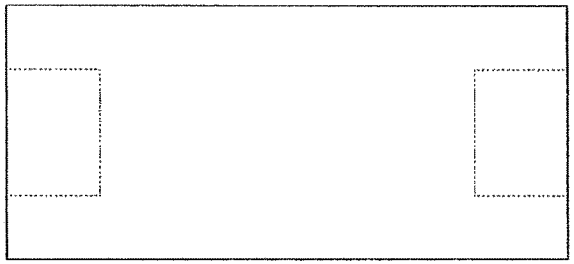
Figure 2I:
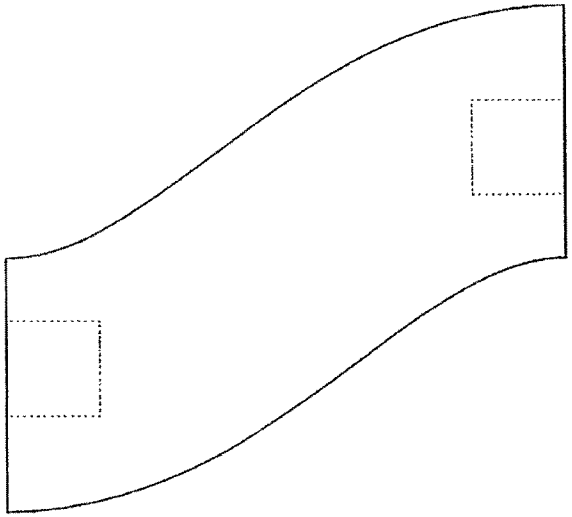
Figure 3I:
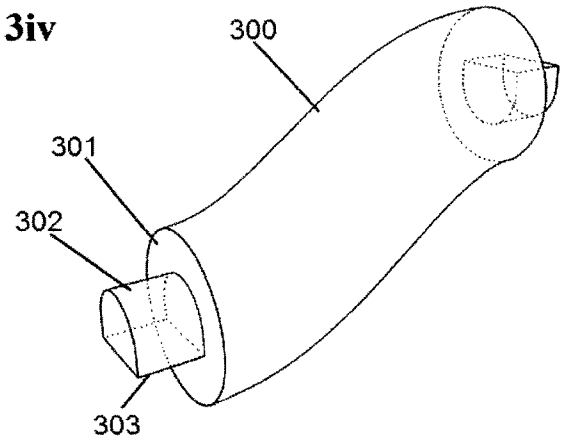
Figure 3I:
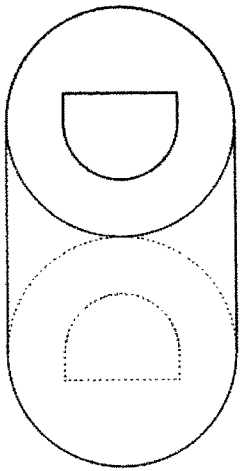
Figure 3I:
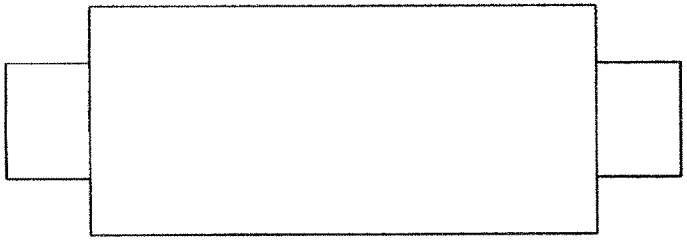
Figure 3I:
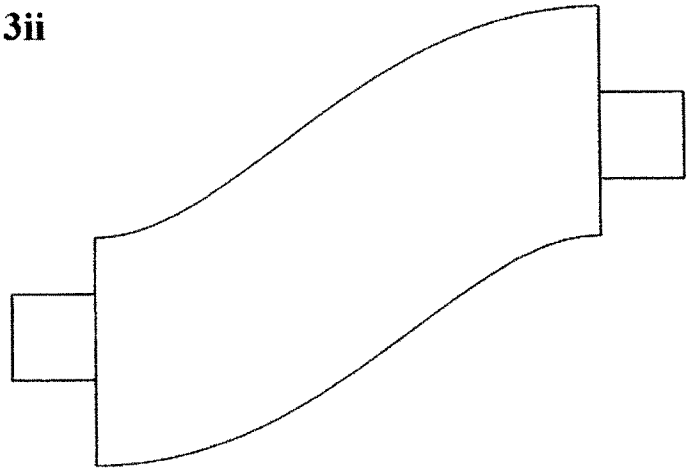
Figure 4I:
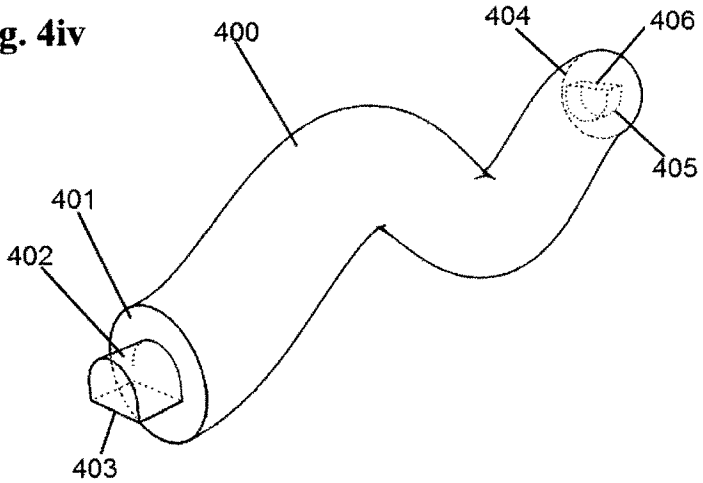
Figure 4I:
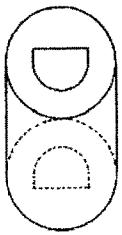
Figure 4I:
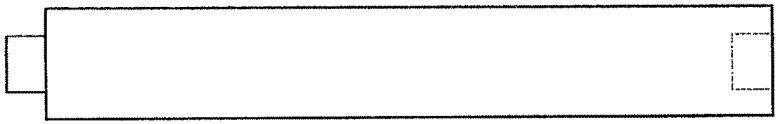
Figure 4I:
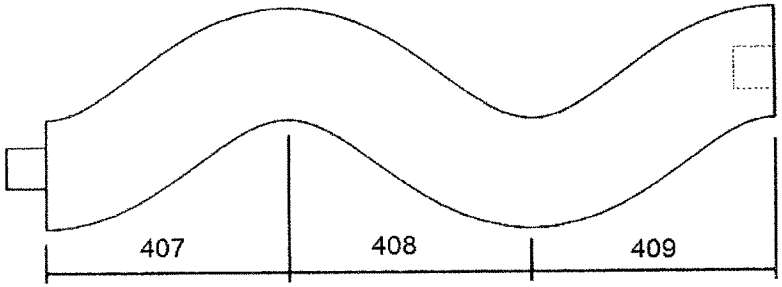

U.S. PATENT DOCUMENTS 4,078,328 A * 3/1978 Rayment ..... A63H 33/108 446/102
4,585,061 A * 4/1986 Lyons, Jr. ..... E21B 19/22 166/77.3
5,049,105 A * 9/1991 Glickman ..... A63H 33/06 446/107
5,188,557 A * 2/1993 Brown ..... A63H 27/005 124/57
5,282,767 A * 2/1994 Gelardi ..... A63H 33/06 446/107
5,314,192 A * 5/1994 Broudy ..... A63F 3/00097 273/282.3
5,664,524 A * 9/1997 Piglia ..... A01K 1/03 119/452
5,752,869 A * 5/1998 Huff ..... A63H 3/16 446/102
6,059,631 A * 5/2000 Maddock ..... A63H 33/082 446/104
6,080,921 A * 6/2000 Cunningham ..... G10D 1/04 84/266
6,325,694 B1 * 12/2001 Clever ..... A63H 33/082 403/165
6,402,581 B1 * 6/2002 Podgaiz ..... A63H 33/04 403/174
6,533,734 B1 * 3/2003 Corley, III ..... A61B 10/0045 119/174
6,641,453 B1 * 11/2003 Morales ..... A63H 33/04 273/157 R
9,948,718 B2 * 4/2018 Yukawa ..... H04L 67/125
2002/0076682 A1 6/2002 Herman
2003/0082986 A1 * 5/2003 Wiens ..... A63H 33/062 446/120
2005/0159076 A1 * 7/2005 Kowalski ..... A63H 33/26 446/137
2007/0281580 A1 * 12/2007 Sambenedetto ..... A63H 33/08 446/124
2008/0188158 A1 * 8/2008 Massa ..... A63H 33/105 446/105
2009/0000022 A1 * 1/2009 Phipps ..... E03C 1/0408 4/601
2010/0151765 A1 * 6/2010 Kwak ..... A63H 33/08 446/124
2012/0184174 A1 * 7/2012 Kwak ..... A63H 33/08 446/124

FOREIGN PATENT DOCUMENTS

FR 2340116 A1 9/1977
FR 2820339 A1 8/2002
GB 2130106 A 5/1984

* cited by examiner

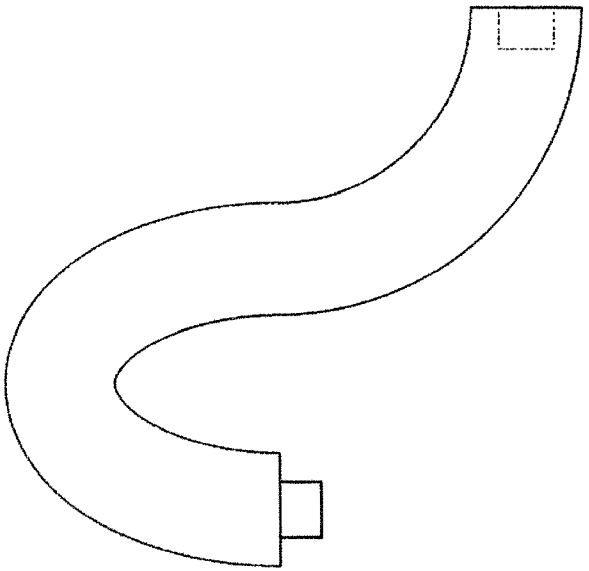
Fig. 6i
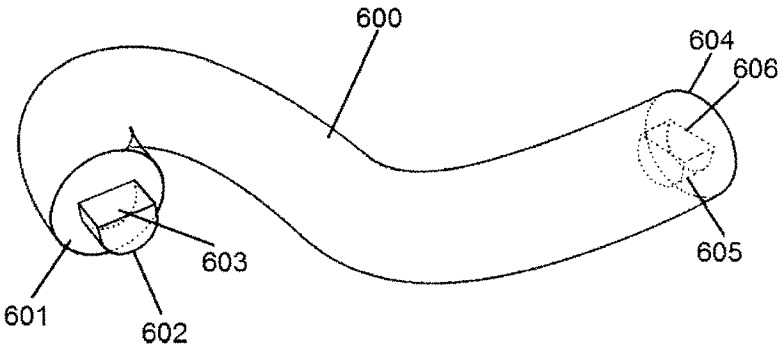
Fig. 6iv
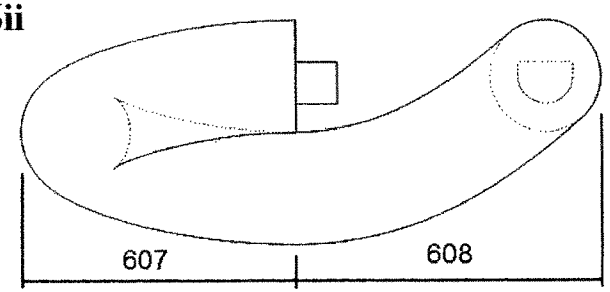
Fig. 6ii
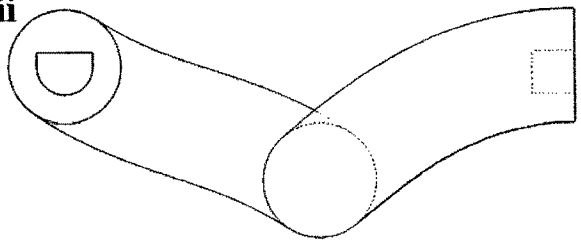
Fig. 6iii

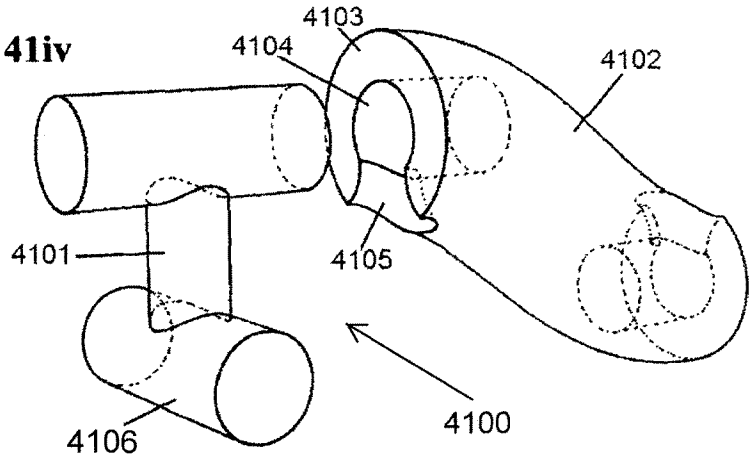
Fig. 41iv
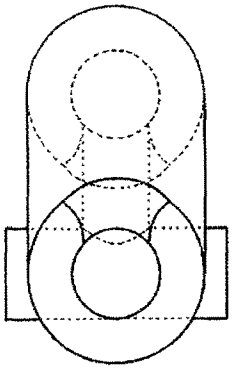
Fig. 41iii
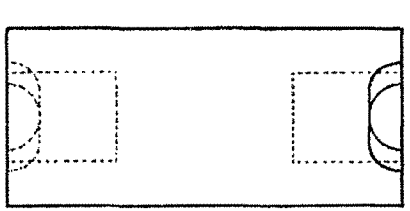
Fig. 41i
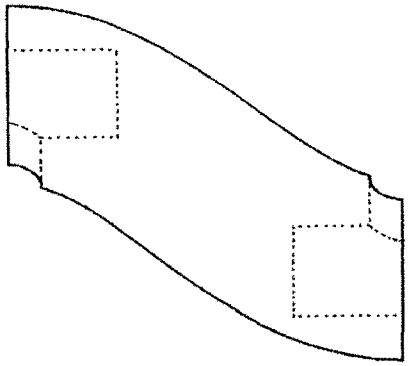
Fig. 41ii
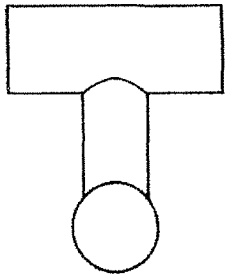

APPARATUS FOR PLAYING A GAME

The present invention generally relates to an apparatus for playing a game. More particularly, the invention relates to an apparatus or to a system to build Celtic style knots or weaving in three dimensions. It can be used for purposes such as toys, games, puzzles, construction sets, decorative items, gifts, education, tiling, lighting and sculpture to name a few, but can be put to other purposes too.

The present invention is more particularly defined in the appended claims which are hereby incorporated into the description.

The invention will hereinafter be more particularly described with reference to the accompanying drawings which show, by way of example only, two versions of an apparatus according to the invention, namely the Male/Female (M/F) version and the Female/Female (F/F) version.

Figures 27, 27I:
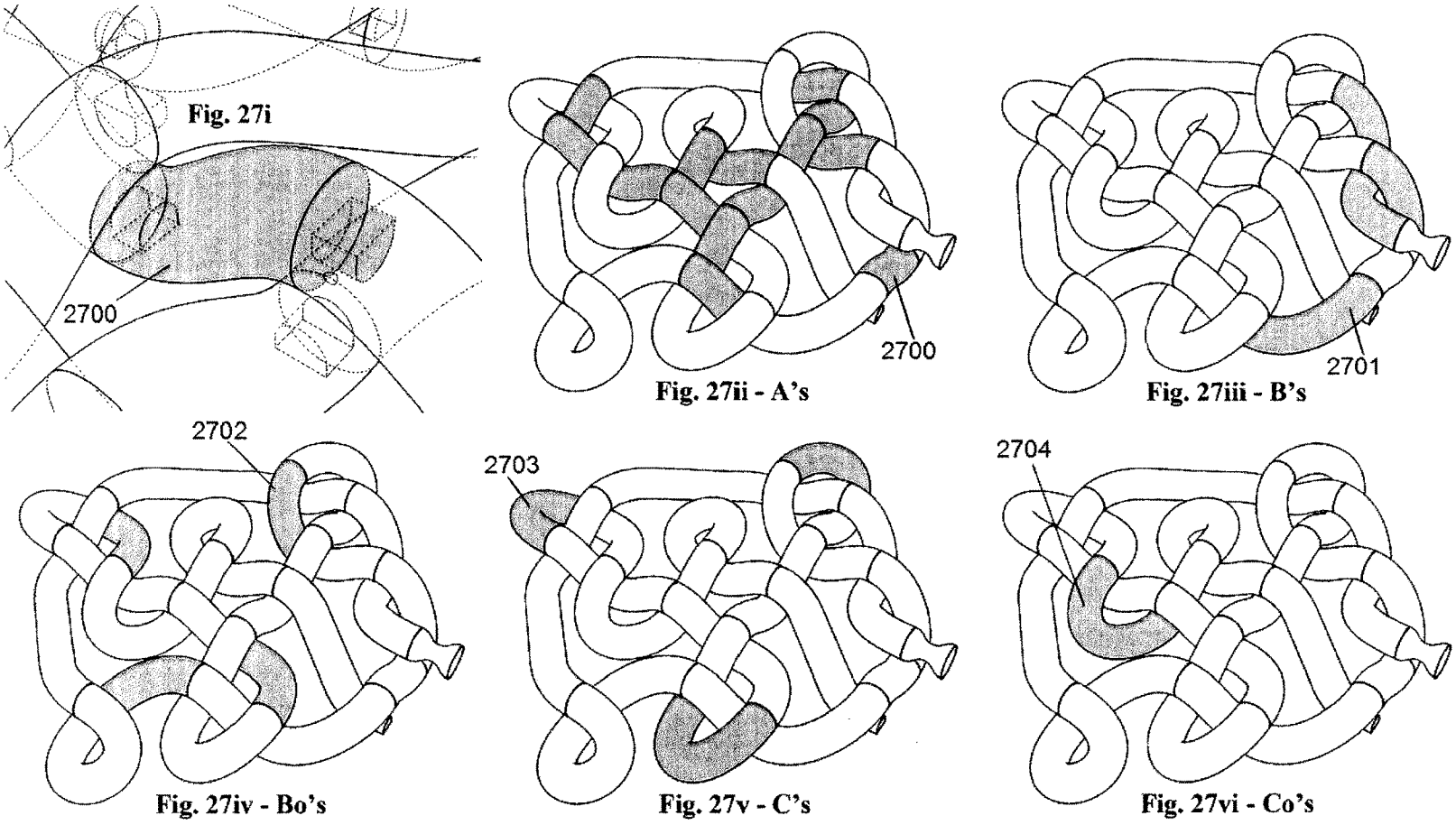
Figure 28:
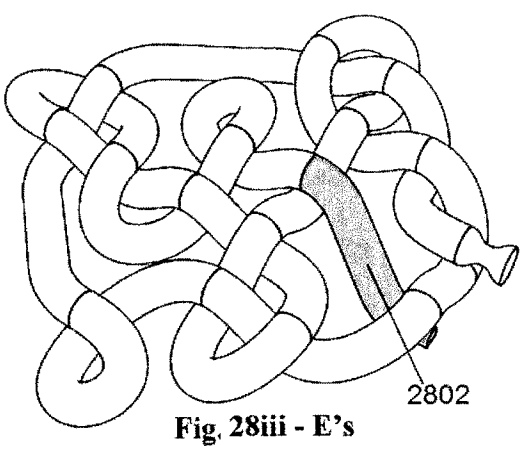
Figure 28:
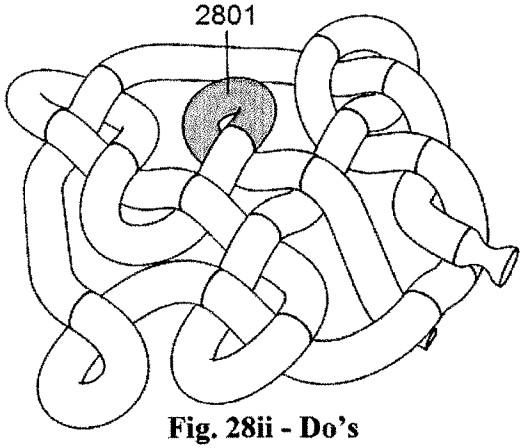
Figure 28:
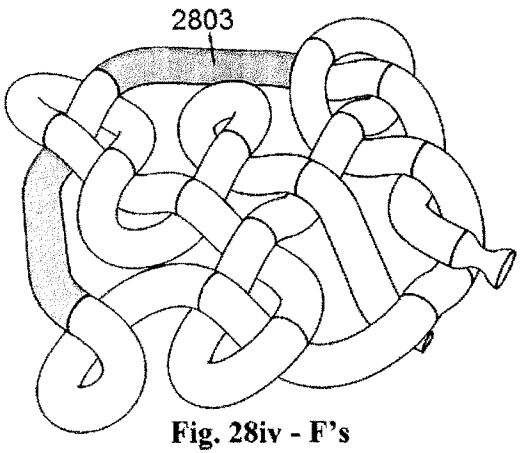
Figure 28:
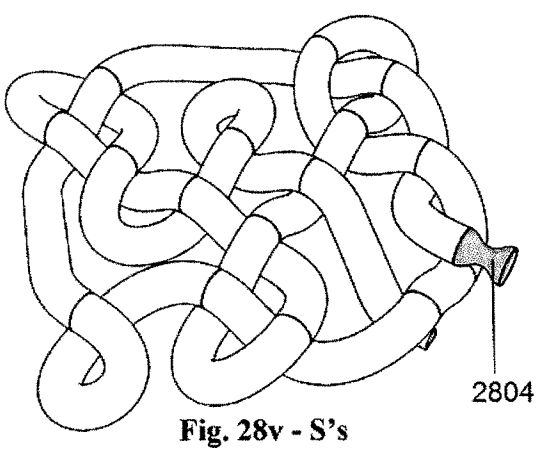
Figure 29:
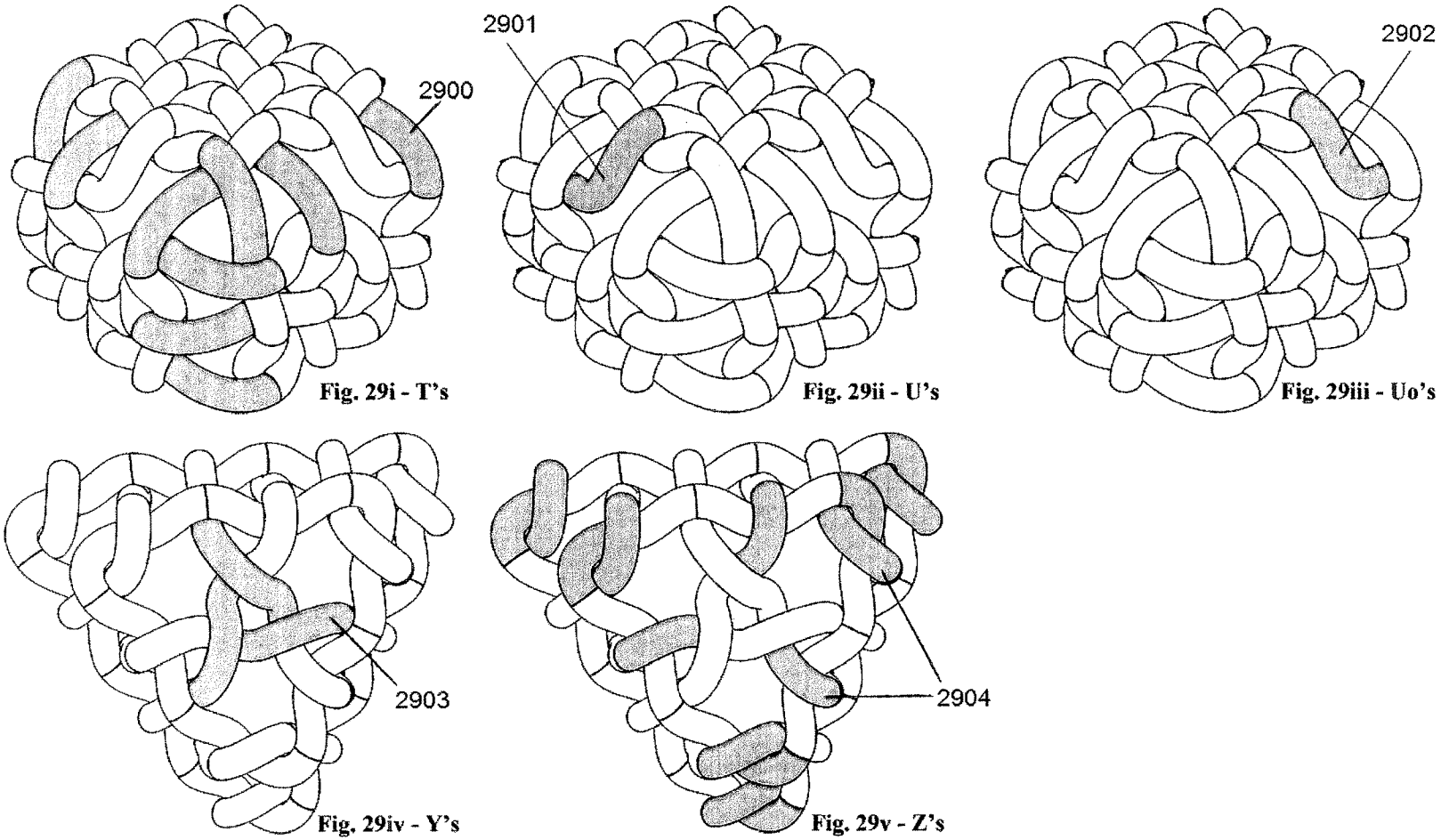
Figure 30I:
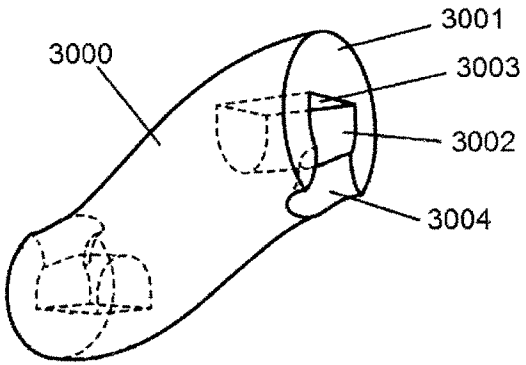
Figure 30I:
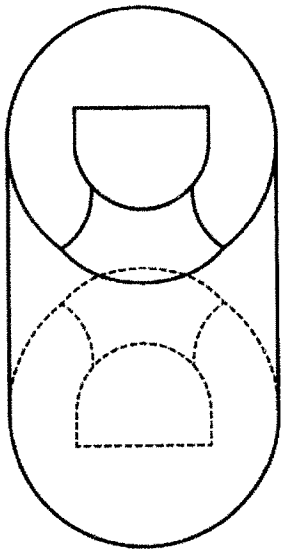
Figure 30I:
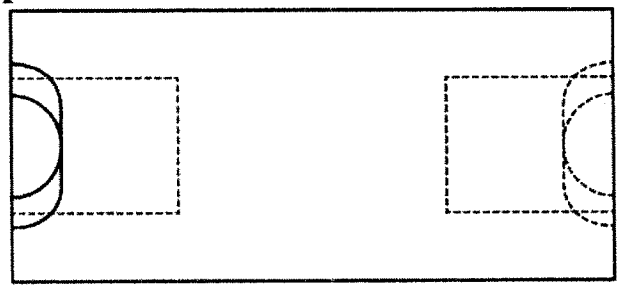
Figure 30I:
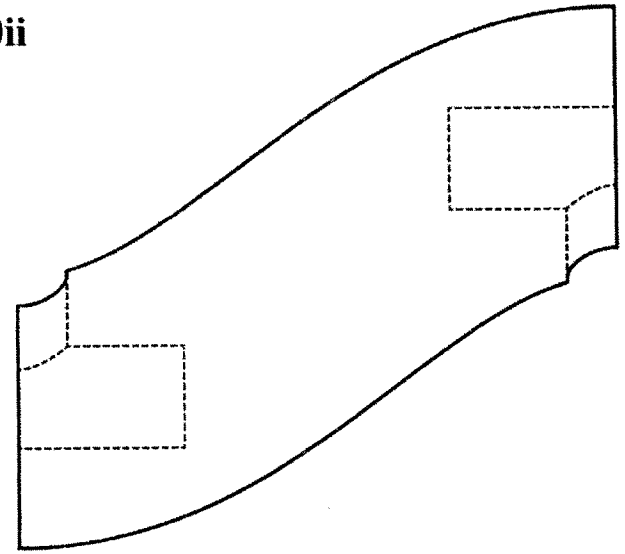

In the drawings in relation to the Male/Female M/F version:

FIG. 1 is A M/Fv1 Push; FIG. 1i being a plan view; FIG. 1ii a side view; FIG. 1iii an end view and FIG. 1iv is a perspective view;

FIG. 2 is A−M/Fv1 Push; FIG. 2i being a plan view; FIG. 2ii a side view; FIG. 2iii an end view and FIG. 2iv is a perspective view;

FIG. 3 is A+M/Fv1 Push; FIG. 3i being a plan view; FIG. 3ii a side view; FIG. 3iii an end view and FIG. 3iv is a perspective view;

FIG. 4 is AAA M/Fv1 Push; FIG. 4i being a plan view; FIG. 4ii a side view; FIG. 4iii an end view and FIG. 4iv is a perspective view;

FIG. 5 is B M/Fv1 Push; FIG. 5i being a plan view; FIG. 5ii a side view; FIG. 5iii an end view and FIG. 5iv is a perspective view;

FIG. 6 is BC M/Fv1 Push; FIG. 6i being a plan view; FIG. 6ii a side view; FIG. 6iii an end view and FIG. 6iv is a perspective view;

FIG. 7 is Bo M/Fv1 Push; FIG. 7i being a plan view; FIG. 7ii a side view; FIG. 7iii an end view and FIG. 7iv is a perspective view;

FIG. 8 is C M/Fv1 Push; FIG. 8i being a plan view; FIG. 8ii a side view; FIG. 8iii an end view and FIG. 8iv is a perspective view;

FIG. 9 is Co M/Fv1 Push; FIG. 9i being a plan view; FIG. 9ii a side view; FIG. 9iii an end view and FIG. 9iv is a perspective view;

FIG. 10 is D M/Fv1 Push; FIG. 10i being a plan view; FIG. 10ii a side view; FIG. 10iii an end view and FIG. 10iv is a perspective view;

FIG. 11 is Do M/Fv1 Push; FIG. 11i being a plan view; FIG. 11ii a side view; FIG. 11iii an end view and FIG. 11iv is a perspective view;

FIG. 12 is D M/Fv1 Push One Piece; FIG. 12i being a plan view; FIG. 12ii a side view; FIG. 12iii an end view and FIG. 12iv is a perspective view;

FIG. 13 is E M/Fv1 Push; FIG. 13i being a plan view; FIG. 13ii a side view; FIG. 13iii an end view and FIG. 13iv is a perspective view;

FIG. 14 is EAZ M/Fv1 Push; FIG. 14i being a plan view; FIG. 14ii a side view; FIG. 14iii an end view and FIG. 14iv is a perspective view;

FIG. 15 is F M/Fv1 Push; FIG. 15i being a plan view; FIG. 15ii a side view; FIG. 15iii an end view and FIG. 15iv is a perspective view;

FIG. 16 is S M/Fv1 Push; FIG. 16i being a plan view; FIG. 16ii a side view; FIG. 16iii an end view and FIG. 16iv is a perspective view;

FIG. 17 is T M/Fv1 Push; FIG. 17i being a plan view; FIG. 17ii a side view; FIG. 17iii an end view and FIG. 17iv is a perspective view;

FIG. 18 is U M/Fv1 Push; FIG. 18i being a plan view; FIG. 18ii a side view; FIG. 18iii an end view and FIG. 18iv is a perspective view;

FIG. 19 is Y M/Fv1 Push; FIG. 19i being a plan view; FIG. 19ii a side view; FIG. 19iii an end view and FIG. 19iv is a perspective view;

FIG. 20 is Z M/Fv1 Push; FIG. 20i being a plan view; FIG. 20ii a side view; FIG. 20iii an end view and FIG. 20iv is a perspective view;

FIG. 21 is Zo M/Fv1 Push; FIG. 21i being a plan view; FIG. 21ii a side view; FIG. 21iii an end view and FIG. 21iv is a perspective view;

FIG. 22 is A M/Fv2 Push; FIG. 22i being a plan view; FIG. 22ii a side view; FIG. 22iii an end view and FIG. 22iv is a perspective view;

FIG. 23 is A M/Fv3 Push; FIG. 23i being a plan view; FIG. 23ii a side view; FIG. 23iii an end view and FIG. 23iv is a perspective view;

FIG. 24 is C M/Fv3 Push; FIG. 24i being a plan view; FIG. 24ii a side view; FIG. 24iii an end view and FIG. 24iv is a perspective view;

FIG. 25 is A M/Fv4 Snap; FIG. 25i being a plan view; FIG. 25ii a side view; FIG. 25iii an end view and FIG. 25iv is a perspective view;

FIG. 26 is A M/Fv5 Snap; FIG. 26i being a plan view; FIG. 26ii a side view; FIG. 26iii an end view and FIG. 26iv is a perspective view;

FIG. 27 is Assembly Part 1; FIG. 27i being a perspective view of an A M/Fv1 Push; FIG. 27ii of "A's"; FIG. 27iii of "B's"; FIG. 27iv of "Bo's"; FIG. 27v of "C's"; and FIG. 27vi of "Co's";

FIG. 28 is Assembly Part 2; FIG. 28i being a perspective view of "D's"; FIG. 28ii of "Do's"; FIG. 28iii of "E's"; FIG. 28iv of "F's"; and FIG. 28v of "S's"; and FIG. 29 is Assembly Part 3; FIG. 29i being a perspective view of "T's"; FIG. 29ii of "U's"; FIG. 29iii of "Uo's"; FIG. 29iv of "Y's"; and FIG. 29v of "Z's.

Figure 46I:
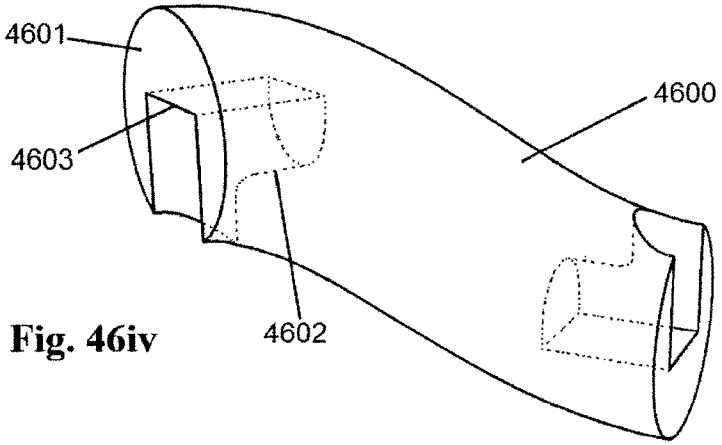
Figure 46I:
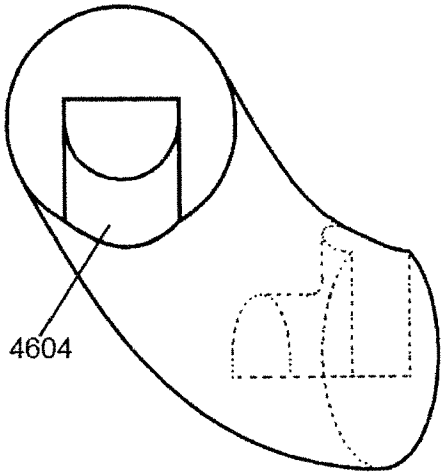
Figure 46I:
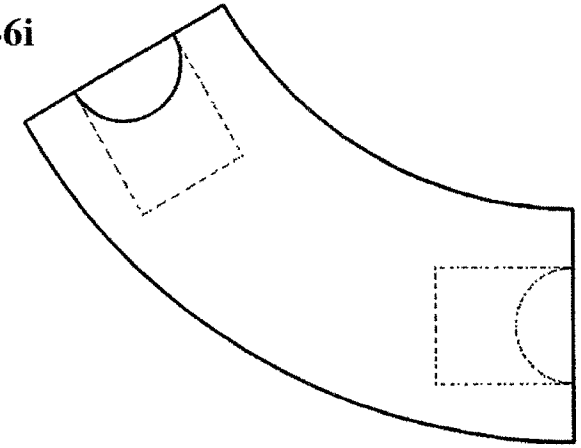
Figure 46I:
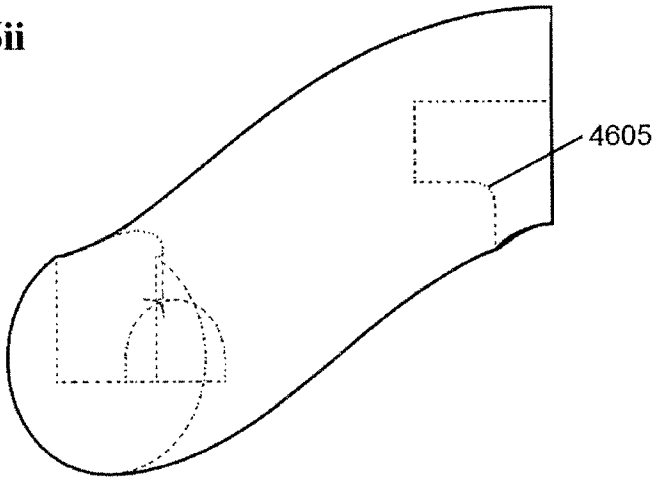
Figure 47I:
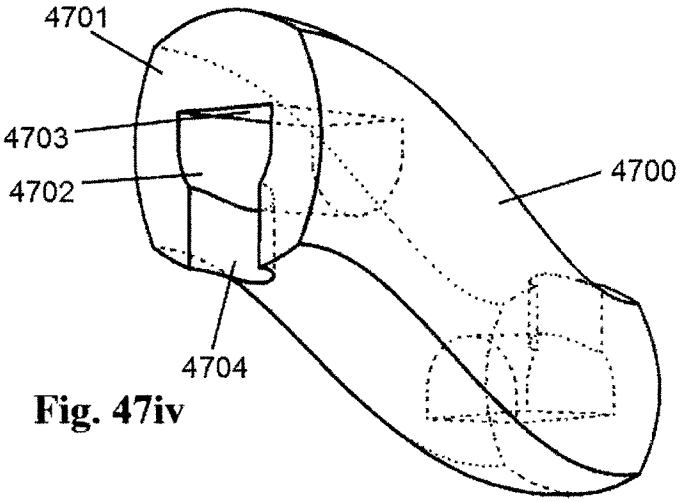
Figure 47I:
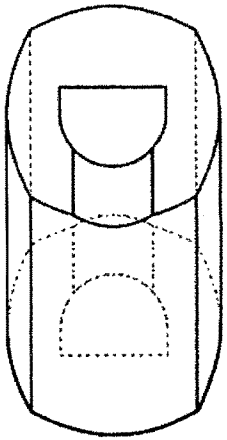
Figure 47I:
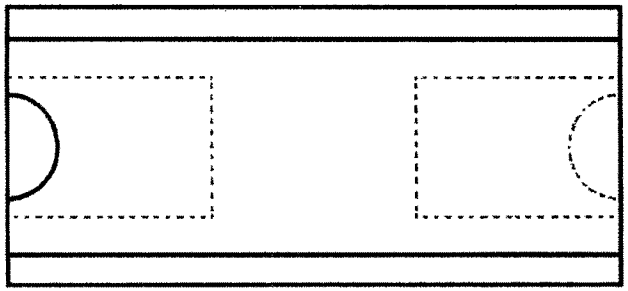
Figure 47I:
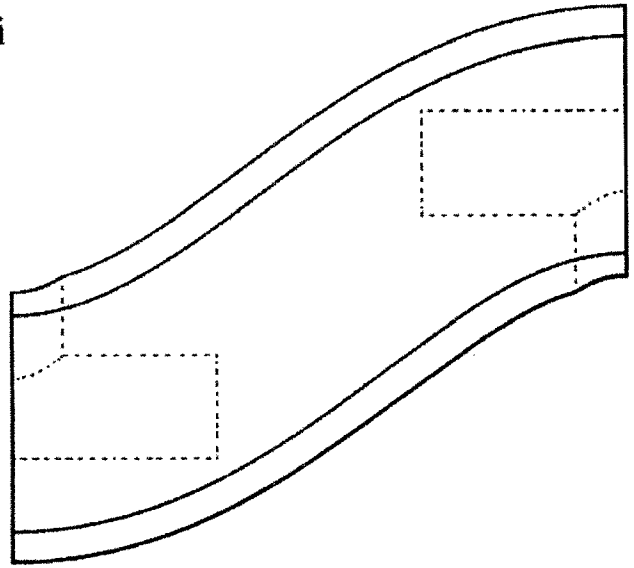

In the drawings in relation to the Female/Female (F/F) version:

FIG. 30 is A F/Fv1 Push; FIG. 30i being a plan view; FIG. 30ii a side view; FIG. 30iii an end view and FIG. 30iv is a perspective view;

FIG. 31 is B F/Fv1 Push; FIG. 31i being a plan view; FIG. 31ii a side view; FIG. 31iii an end view and FIG. 31iv is a perspective view;

FIG. 32 is C F/Fv1 Push; FIG. 32i being a plan view; FIG. 32ii a side view; FIG. 32iii an end view and FIG. 32iv is a perspective view;

FIG. 33 is D F/Fv1 Push; FIG. 33i being a plan view; FIG. 33ii a side view; FIG. 33iii an end view and FIG. 33iv is a perspective view;

FIG. 34 is D F/Fv1 Push Split; FIG. 34i being a plan view; FIG. 34ii a side view; FIG. 34iii an end view and FIG. 34iv is a perspective view;

FIG. 35 is Jv1 F/Fv1 Push; FIG. 35i being a plan view; FIG. 35ii a side view; FIG. 35iii an end view and FIG. 35iv is a perspective view;

FIG. 36 is Jv2 F/Fv1 Push; FIG. 36i being a plan view; FIG. 36ii a side view; FIG. 36iii an end view and FIG. 36iv is a perspective view;

FIG. 37 is Jv3 F/Fv1 Push; FIG. 37i being a plan view; FIG. 37ii a side view; FIG. 37iii an end view and FIG. 37iv is a perspective view;

FIG. 38 is Jv4 F/Fv1 Push; FIG. 38i being a plan view; FIG. 38ii a side view; FIG. 38iii an end view and FIG. 38iv is a perspective view;

FIG. 39 is S F/Fv1 Push; FIG. 39i being a plan view; FIG. 39ii a side view; FIG. 39iii an end view and FIG. 39iv is a perspective view;

FIG. 40 is A & J F/Fv2 Snap; FIG. 40i being a plan view; FIG. 40ii a side view; FIG. 40iii an end view and FIG. 40iv is a perspective view;

FIG. 41 is A & J F/Fv3 Push; FIG. 41i being a plan view; FIG. 41ii a side view; FIG. 41iii an end view and FIG. 41iv is a perspective view;

FIG. 42 is Assembly F/Fv1 Push; FIG. 42i being a plan view; FIG. 42ii a side view; FIG. 42iii an end view and FIG. 42iv is a perspective view;

FIG. 43 is A F/Fv4 Push; FIG. 43i being a plan view; FIG. 43ii a side view; FIG. 43iii an end view and FIG. 43iv is a perspective view;

FIG. 44 is J F/Fv5 Snap; FIG. 44i being a plan view; FIG. 44ii a side view; FIG. 44iii an end view and FIG. 44iv is a perspective view;

FIG. 45 is a Z F/Fv1 Push; FIG. 45i being a side view; FIG. 45ii being a plan view; FIG. 45 iii being an end view and FIG. 45iv being a perspective view;

FIG. 46 is a 60 degree bend F/Fv4 Push; FIG. 46i being a side view; FIG. 46ii being a plan view; FIG. 46iii being an end view and FIG. 46iv being a perspective view; and FIG. 47 is a non-round A F/Fv1 Push; FIG. 47i being a side view; FIG. 47ii being a plan view; FIG. 47iii being an end view and FIG. 47iv being a perspective view;

DETAILED DESCRIPTION OF MALE/FEMALE (M/F) VERSION

Referring to FIG. 1, the A M/Fv1 push element 100 has mating surfaces 101 and 104 at each end of the piece. An engaging element 102 with a flat face 103 extends from the mating surface 101. A complementary shaped receiving orifice 105 having a flat face 106 is provided on the mating surface 104 for mutual engagement of the pieces.

As shown in FIG. 2, the A- M/Fv1 push element 200 has two identical mating surfaces 201, one at each end. A receiving orifice 202 with a flat face 203 is provided on both mating surfaces 201.

Referring to FIG. 3, the A+M/Fv1 push element 300 has two identical mating surfaces 301, one at each end. An engaging element 302 with a flat face 303 is provided on both mating surfaces 301.

As shown in FIG. 4, the AAA M/Fv1 push element 400 has a mating surfaces 401 and 404 at each end of the piece. An engaging element 402 with a flat face 403 extends from the mating surface 401. A complementary shaped receiving orifice 405 having a flat surface 406 is provided on the mating surface 404 for mutual engagement of the pieces. The length of the element 400 has three distinctive sections 407, 408 and 409, which are each similar to FIG. 1, A M/Fv1 push element; all of which have been amalgamated into one piece.

Figure 5I:
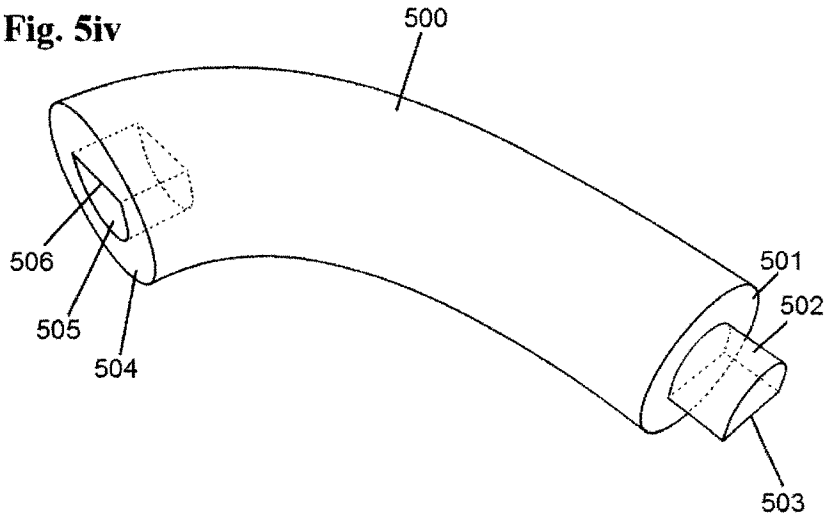
Figure 5I:
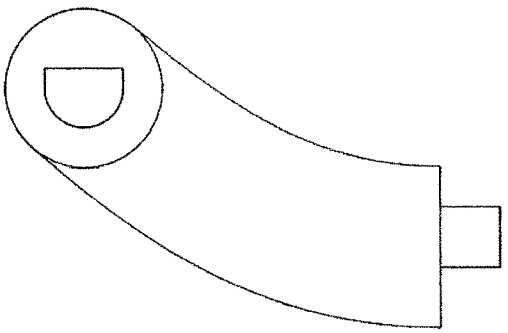
Figure 5I:
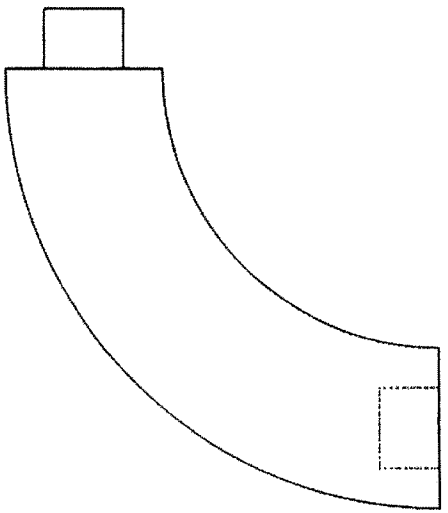
Figure 5I:
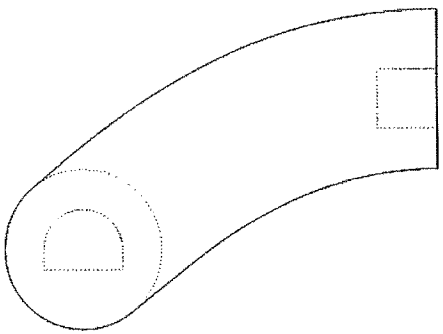

Referring to FIG. 5, the B M/Fv1 push element 500 has a mating surface 501 and 504 at each end of the piece, at 90 degrees relative to one another as shown in FIG. 5i. An engaging element 502 with a flat face 503 extends from the mating surface 501. A complementary shaped receiving orifice 505 having a flat surface 506 is provided on the mating surface 504 for mutual engagement of the pieces.

As shown in FIG. 6, the BC M/Fv1 push element 600 has a mating surface 601 and 604 at each end of the piece. An engaging element 602 with a flat face 603 extends from the mating surface 601. A complementary shaped receiving orifice 605 having a flat surface 606 is provided on the mating surface 604 for mutual engagement of the pieces. The length of the element 600 has two distinctive sections 607 and 608. Section 607 is similar to FIG. 8, the C M/Fv1 push element and 608 is similar to FIG. 5, the B M/Fv1 push element; both of which have been amalgamated into one piece.

Figure 7I:
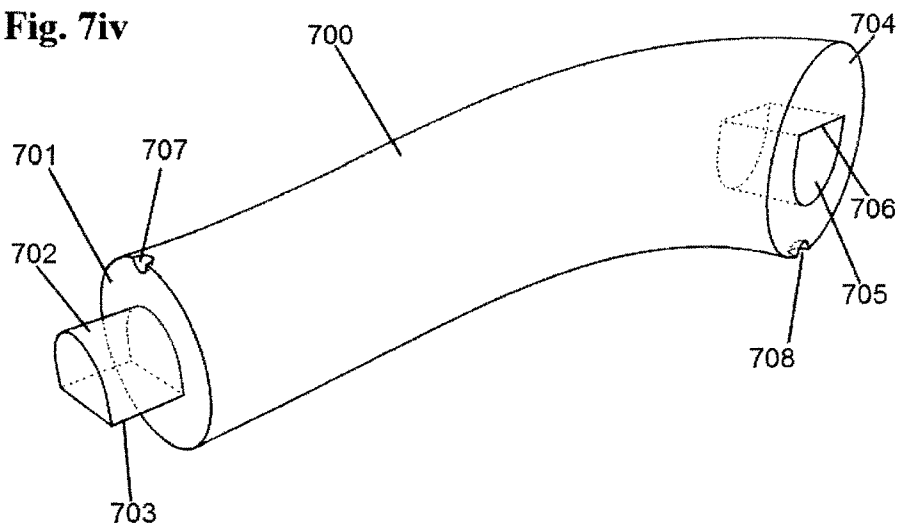
Figure 7I:
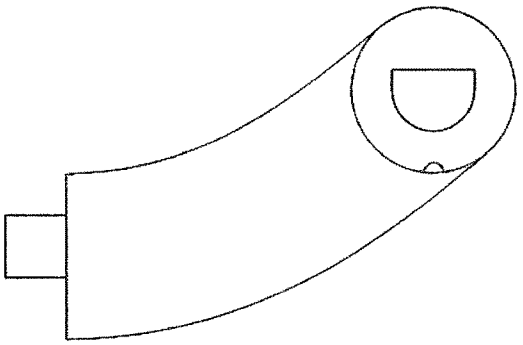
Figure 7I:
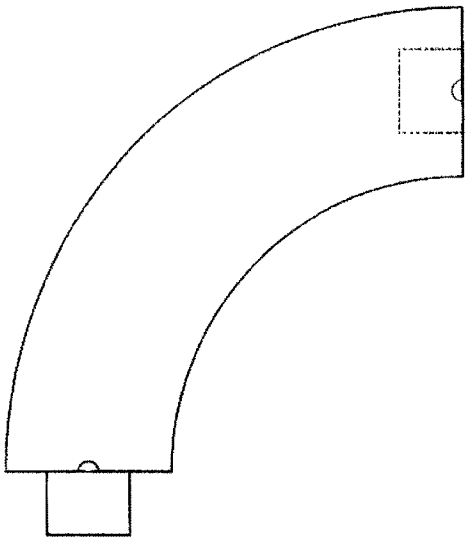
Figure 7I:
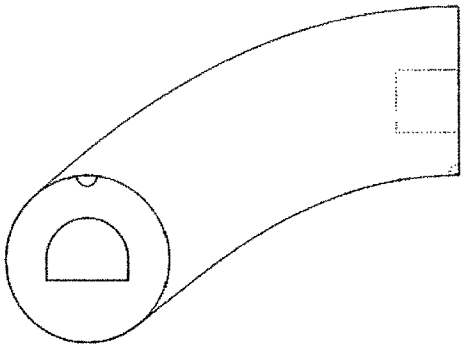

Referring to FIG. 7, the Bo M/Fv1 push element 700 has a mating surface 701 and 704 at each end of the piece, at 90 degrees relative to one another as shown in FIG. 7i. An engaging element 702 with a flat face 703 extends from the mating surface 701. A complementary shaped receiving orifice 705 having a flat surface 706 is provided on the mating surface 704 for mutual engagement of the pieces. A notch 707 is provided on the mating surface 701 and a corresponding notch 708 is provided on the mating surface 704. This is to differentiate the element from FIG. 5, the B M/Fv1 push element, which is a mirror image.

Figure 8I:
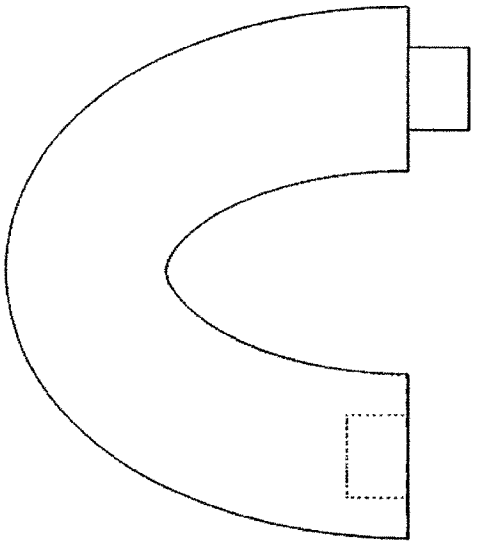
Figure 8I:
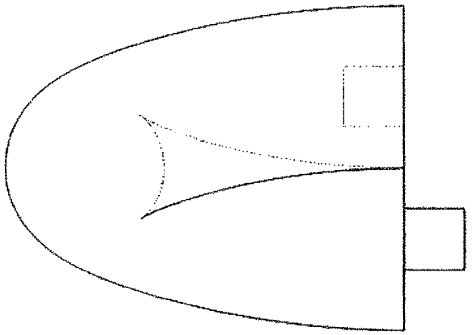
Figure 8I:
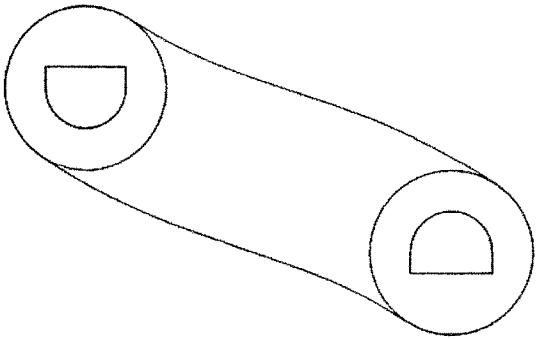
Figure 8I:
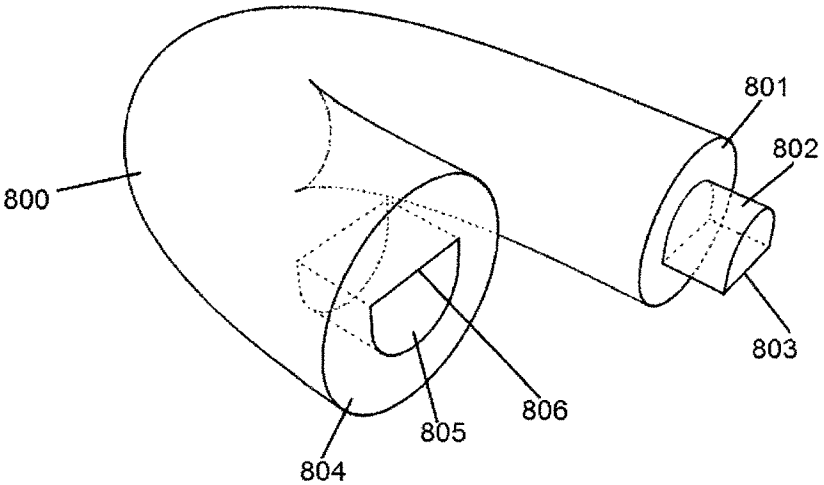

Referring to FIG. 8, the C M/Fv1 push element 800 has a mating surface 801 and 804 at each end of the piece, at 180 degrees relative to one another as shown in FIG. 8i. An engaging element 802 with a flat face 803 extends from the mating surface 801. A complementary shaped receiving orifice 805 having a flat surface 806 is provided on the mating surface 804 for mutual engagement of the pieces.

Figure 9I:
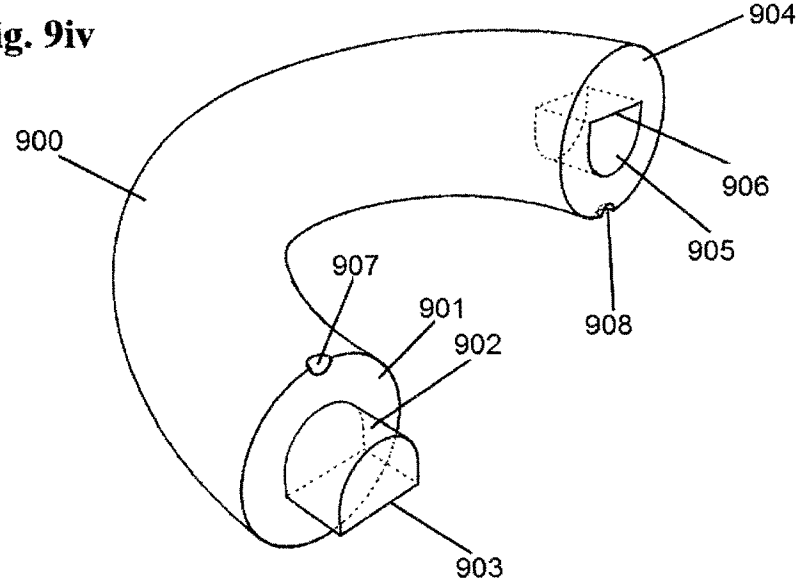
Figure 9I:
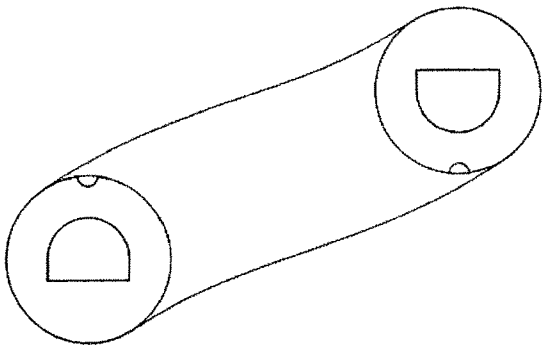
Figure 9I:
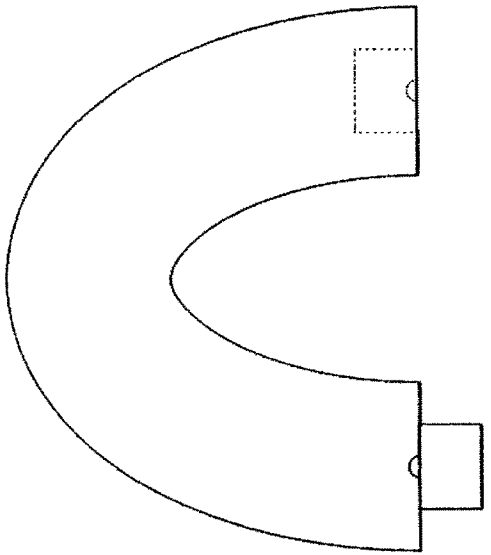
Figure 9I:
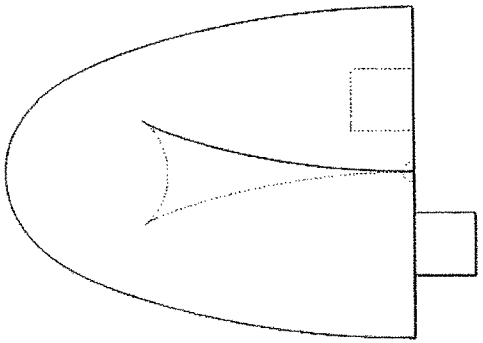

Referring to FIG. 9, the Co M/Fv1 push element 900 has a mating surface 901 and 904 at each end of the piece, at 180 degrees relative to one another as shown in FIG. 9i. An engaging element 902 with a flat face 903 extends from the mating surface 901. A complementary shaped receiving orifice 905 having a flat surface 906 is provided on the mating surface 904 for mutual engagement of the pieces. A notch 907 is provided on the mating surface 901 and a corresponding notch 908 is provided on the mating surface 904. This is to differentiate the element from FIG. 8, the C M/Fv1 push element, which is a mirror image.

Figure 10I:
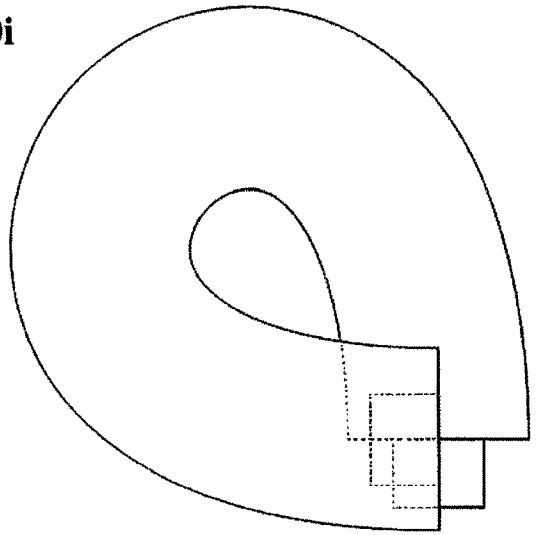
Figure 10I:
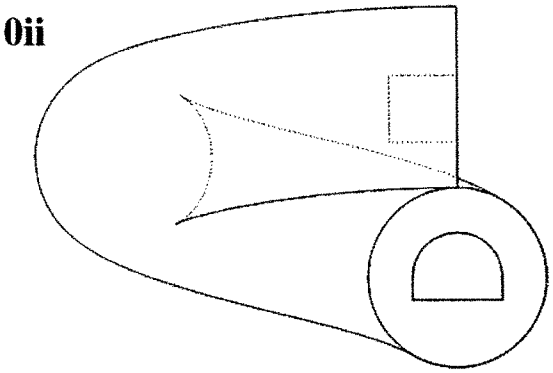
Figure 10I:
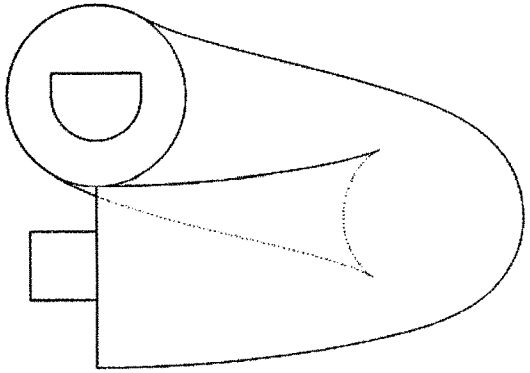
Figure 10I:
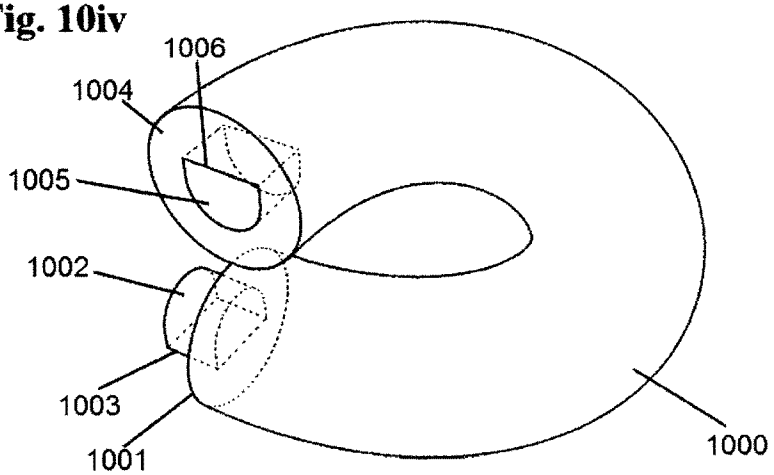

Referring to FIG. 10, the D M/Fv1 push element 1000 has a mating surface 1001 and 1004 at each end of the piece, at 270 degrees relative to one another as shown in FIG. 10i. An engaging element 1002 with a flat face 1003 extends from the mating surface 1001. A complementary shaped receiving orifice 1005 having a flat surface 1006 is provided on the mating surface 1004 for mutual engagement of the pieces.

Figure 11I:
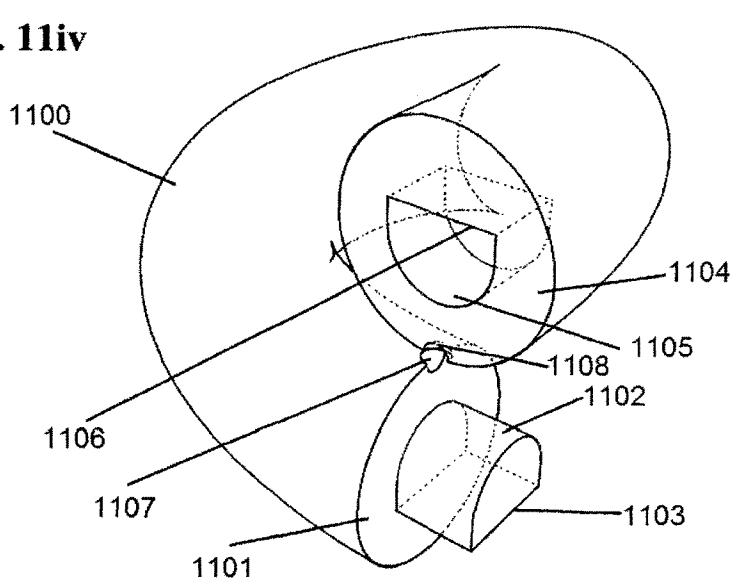
Figure 11I:
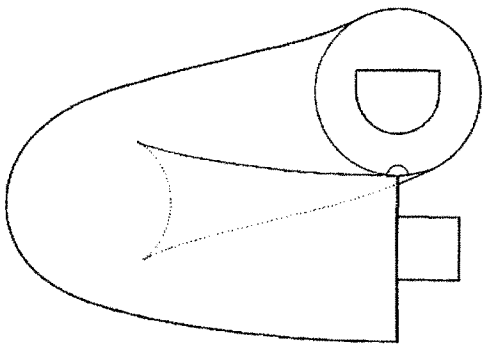
Figure 11I:
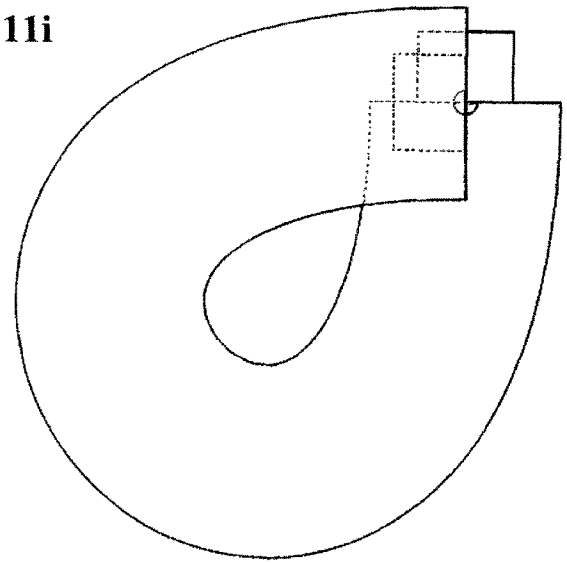
Figure 11I:
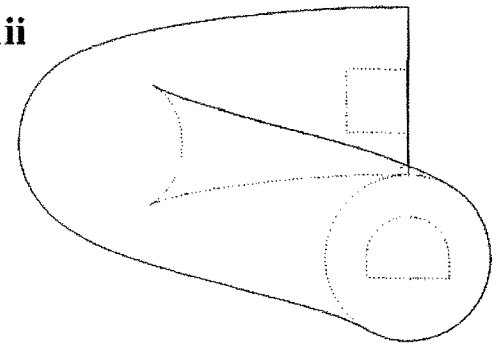

Referring to FIG. 11, the Do M/Fv1 push element 1100 has a mating surface 1101 and 1104 at each end of the piece, at 270 degrees relative to one another as shown in FIG. 11i. An engaging element 1102 with a flat face 1103 extends from the mating surface 1101. A complementary shaped receiving orifice 1105 having a flat surface 1106 is provided on the mating surface 1104 for mutual engagement of the pieces. A notch 1107 is provided on the mating surface 1101 and a corresponding notch 1108 is provided on the mating surface 1104. This is to differentiate the element from FIG. 10, the D M/Fv1 push element, which is a mirror image.

Figure 12I:
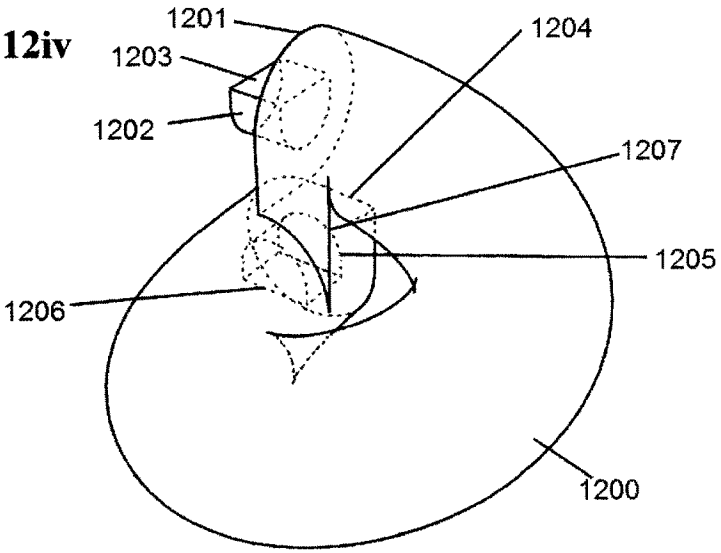
Figure 12I:
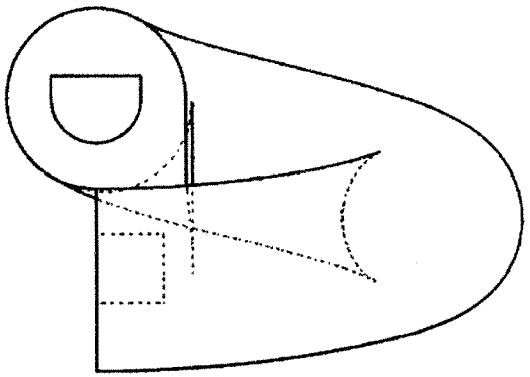
Figure 12I:
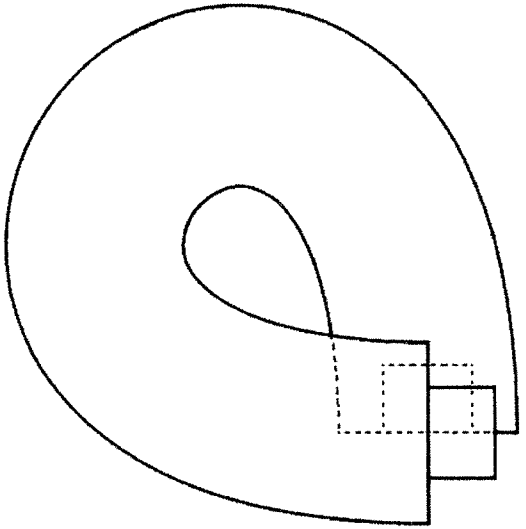
Figure 12I:
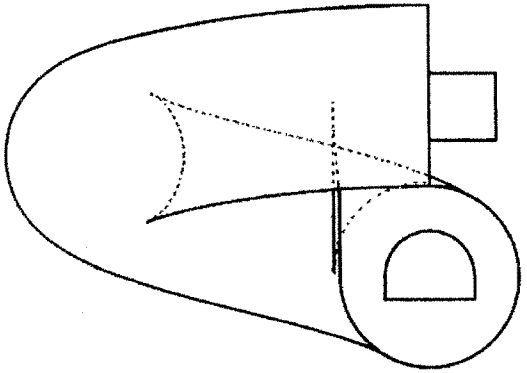
Figure 13I:
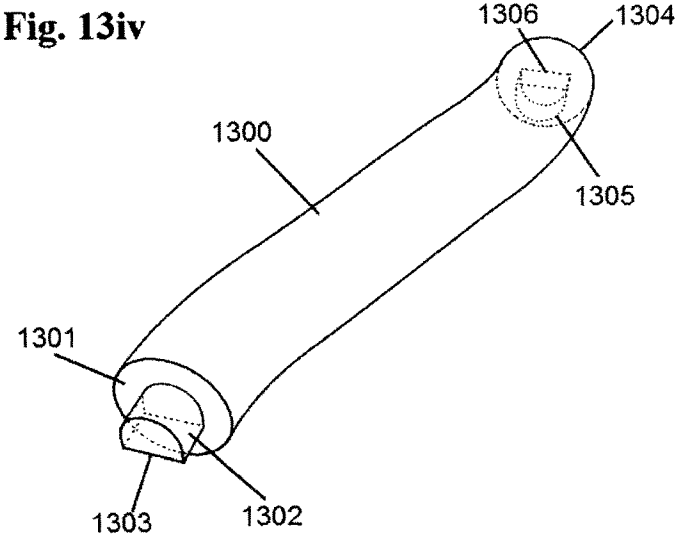
Figure 13I:
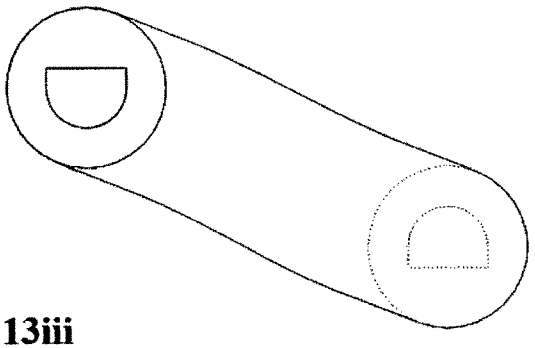
Figure 13I:
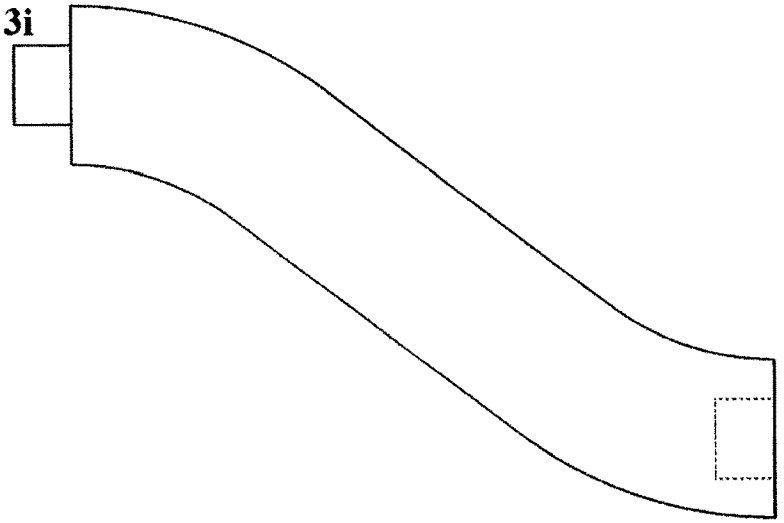
Figure 13I:
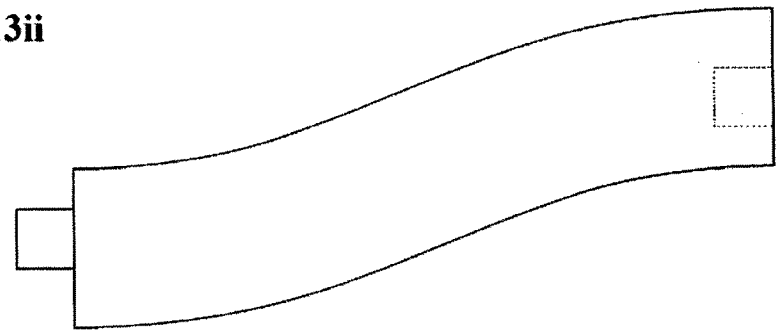
Figure 14I:
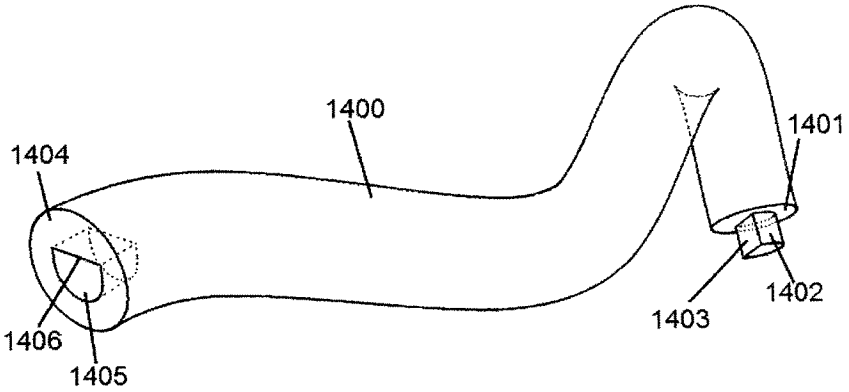
Figure 14I:
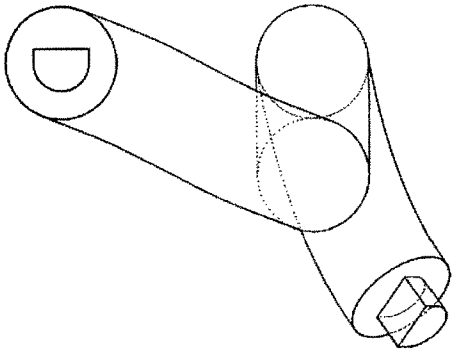
Figure 14I:
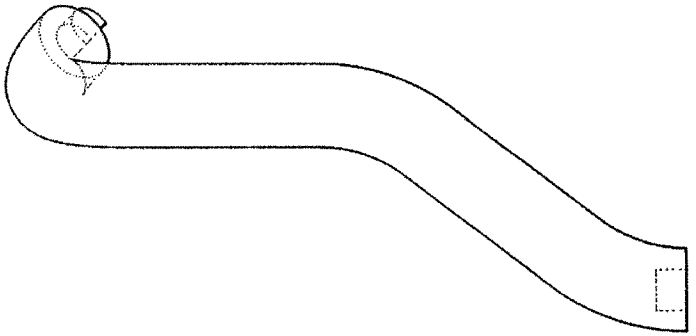
Figure 14I:
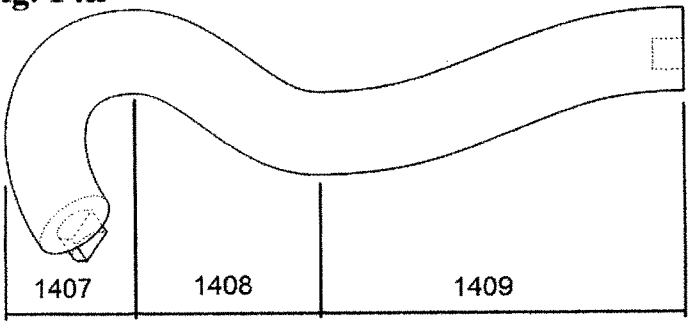

Referring to FIG. 12, the D M/Fv1 push one piece element 1200 has a mating surface 1201 and 1204 at each end of the piece, at 270 degrees relative to one another as shown in FIG. 12i. An engaging element 1202 with a flat face 1203 extends from the mating surface 1201. A complementary shaped receiving orifice 1205 having a flat surface 1206 is provided on the mating surface 1204 for mutual engagement of the pieces. The two ends are joined together with element 1207 which removes the undercuts from the piece and enables it to be injection moulded in one piece and ejected from the tool.

Referring to FIG. 13, the E M/Fv1 push element 1300 has a mating surface 1301 and 1304 at each end of the piece. An engaging element 1302 with a flat face 1303 extends from the mating surface 1301. A complementary shaped receiving orifice 1305 having a flat surface 1306 is provided on the mating surface 1304 for mutual engagement of the pieces.

As shown in FIG. 14, the EAZ M/Fv1 push element 1400 has a mating surface 1401 and 1404 at each end of the piece. An engaging element 1402 with a flat face 1403 extends from the mating surface 1401. A complementary shaped receiving orifice 1405 having a flat surface 1406 is provided on the mating surface 1404 for mutual engagement of the pieces. The length of the element 1400 has three distinctive sections 1407, 1408 and 1409. Section 1407 is similar to FIG. 20, the Z M/Fv1 push element, section 1408 is similar to FIG. 1, the A M/Fv1 push element and section 1409 is similar to FIG. 13, the E M/Fv1 push element; all of which have been amalgamated into one piece.

Figure 15I:
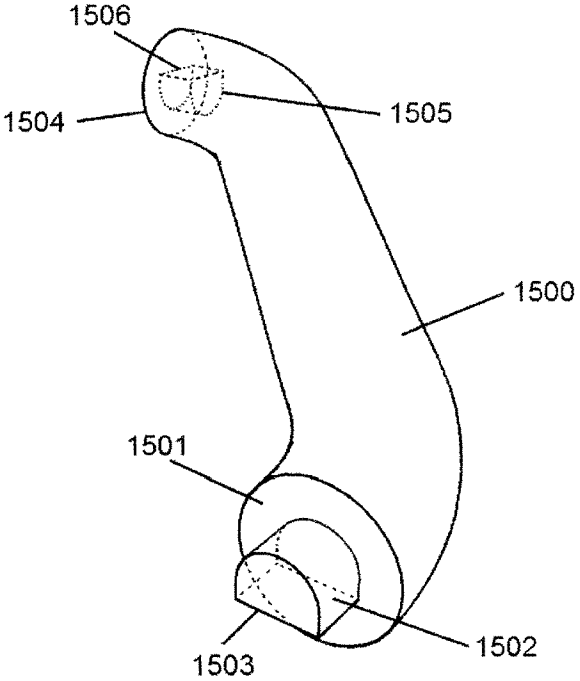
Figure 15I:
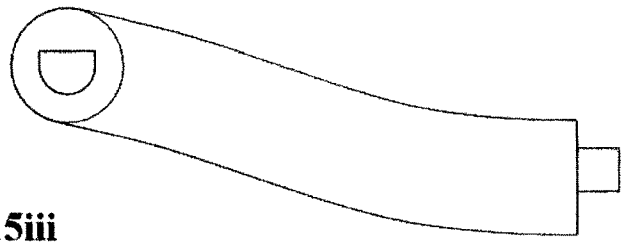
Figure 15I:
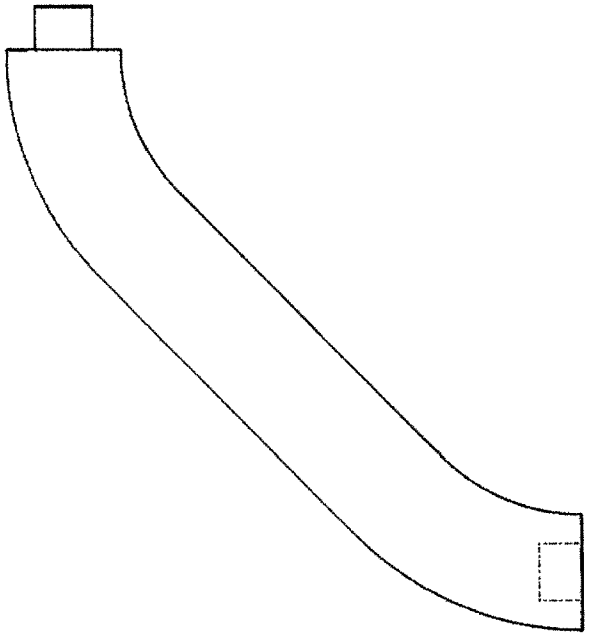
Figure 15I:
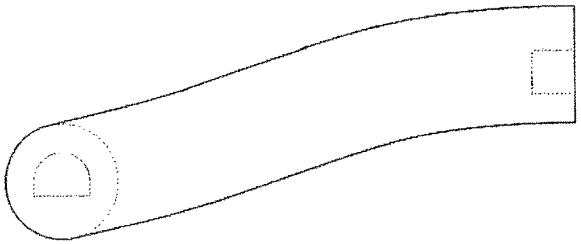
Figure 16I:
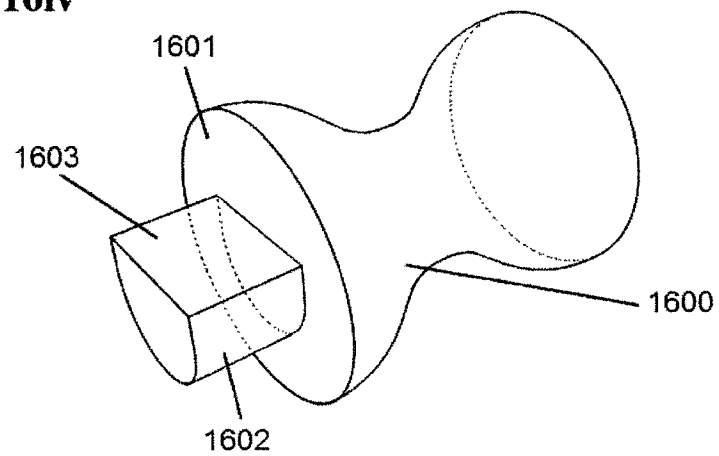
Figure 16I:
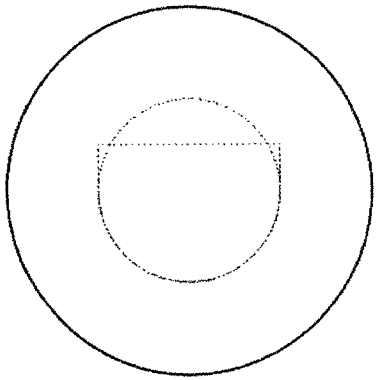
Figure 16I:
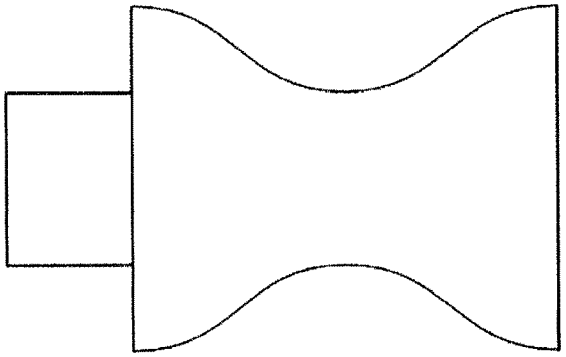
Figure 16I:
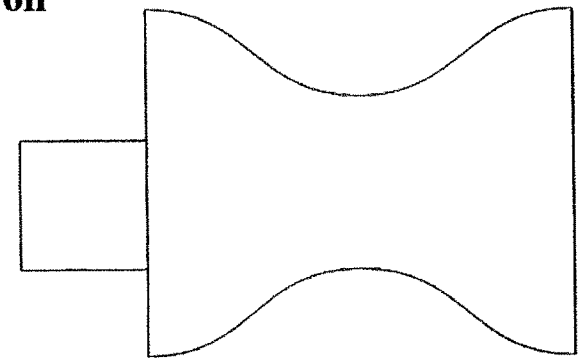

Referring to FIG. 15, the F M/Fv1 push element 1500 has a mating surface 1501 and 1504 at each end of the piece, at 90 degrees relative to one another as shown in FIG. 15i. An engaging element 1502 with a flat face 1503 extends from the mating surface 1501. A complementary shaped receiving orifice 1505 having a flat surface 1506 is provided on the mating surface 1504 for mutual engagement of the pieces.

Referring to FIG. 16, the S M/Fv1 push element 1600 has a single mating surface 1601. An engaging element 1602 with a flat face 1603 extends from the mating surface 1601.

Figure 17I:
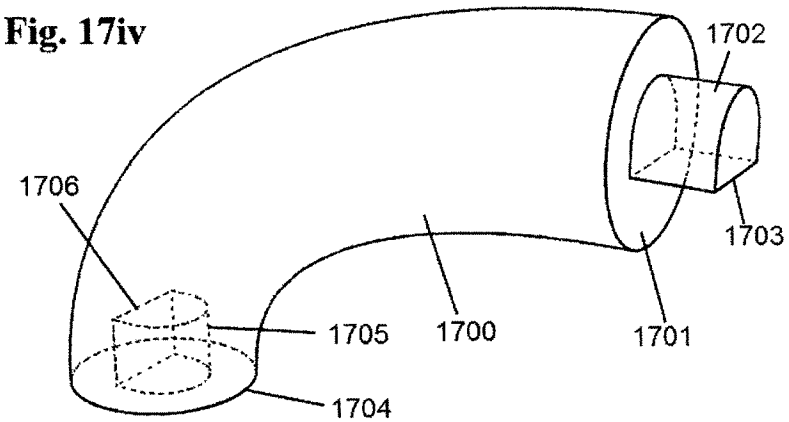
Figure 17I:
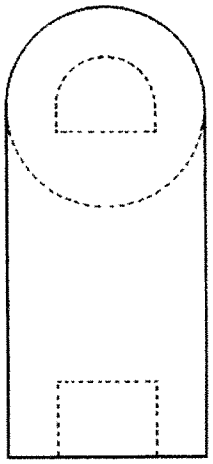
Figure 17I:
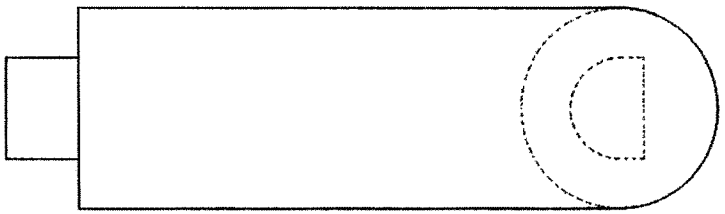
Figure 17I:
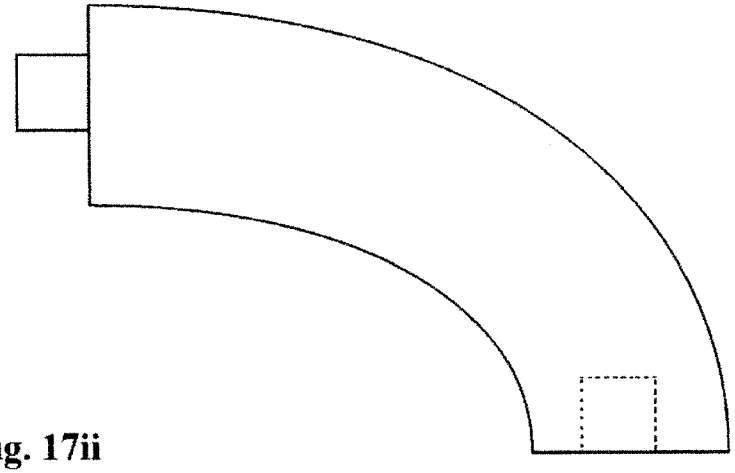

Referring to FIG. 17, the T M/Fv1 push element 1700 has a mating surface 1701 and 1704 at each end of the piece, at 90 degrees relative to one another as shown in FIG. 17ii. An engaging element 1702 with a flat face 1703 extends from the mating surface 1701. A complementary shaped receiving orifice 1705 having a flat surface 1706 is provided on the mating surface 1704 for mutual engagement of the pieces.

Figure 18I:
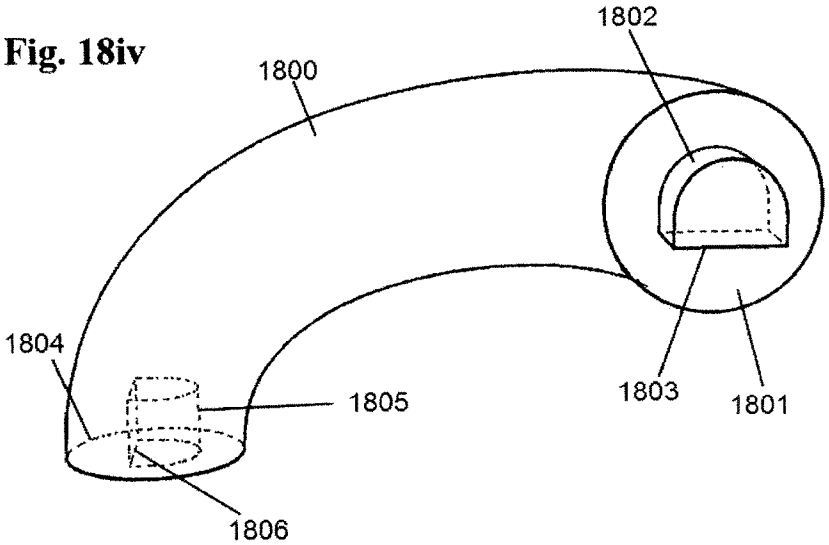
Figure 18I:
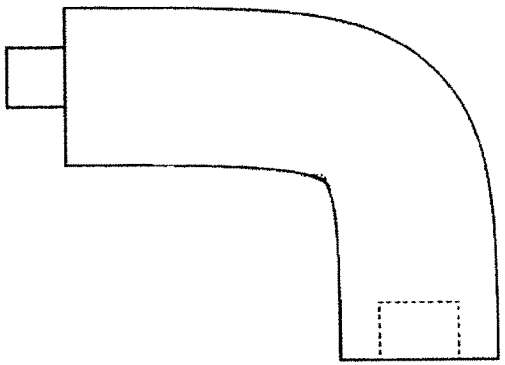
Figure 18I:
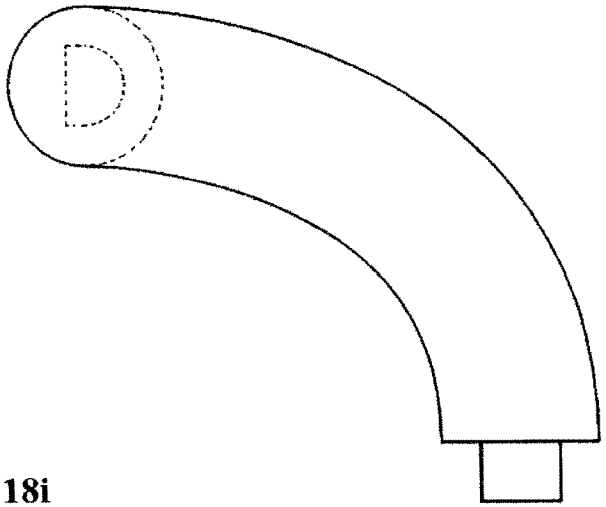
Figure 18I:
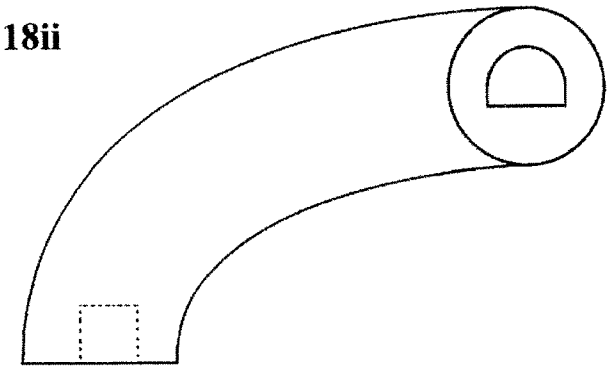
Figure 19I:
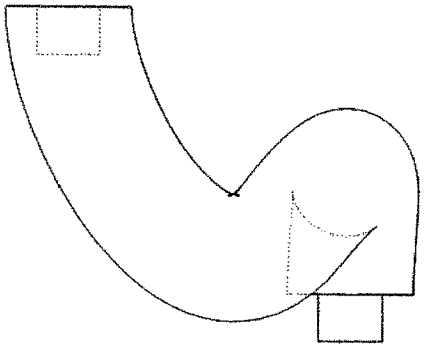
Figure 19I:
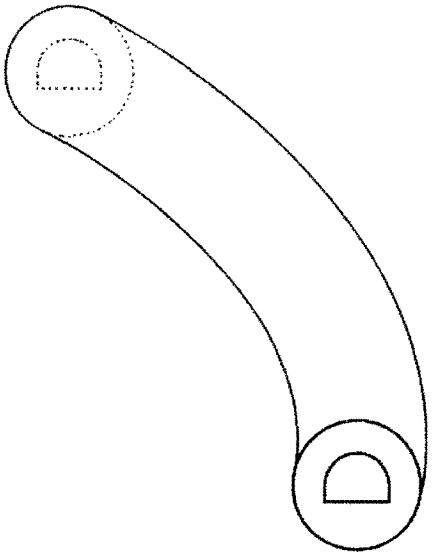
Figure 19I:
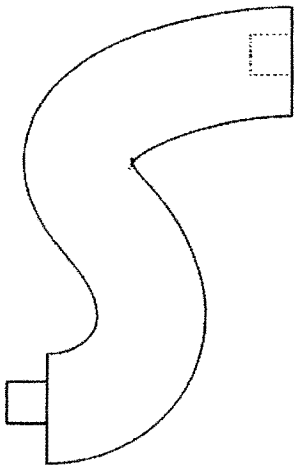
Figure 19I:
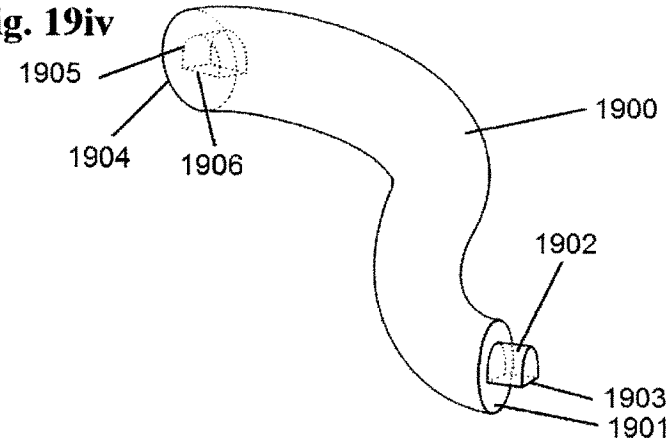

Referring to FIG. 18, the U M/Fv1 push element 1800 has a mating surface 1801 and 1804 at each end of the piece, at 90 degrees relative to one another as shown in FIG. 18iii. An engaging element 1802 with a flat face 1803 extends from the mating surface 1801. A complementary shaped receiving orifice 1805 having a flat surface 1806 is provided on the mating surface 1804 for mutual engagement of the pieces.

Referring to FIG. 19, the Y M/Fv1 push element 1900 has a mating surface 1901 and 1904 at each end of the piece. An engaging element 1902 with a flat face 1903 extends from the mating surface 1901. A complementary shaped receiving orifice 1905 having a flat surface 1906 is provided on the mating surface 1904 for mutual engagement of the pieces.

Figure 20I:
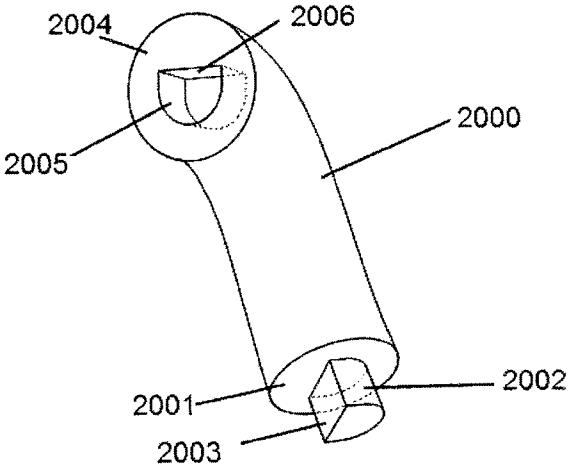
Figure 20I:
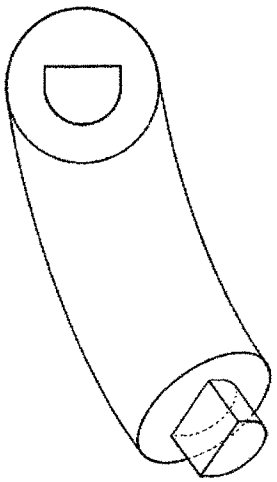
Figure 20I:
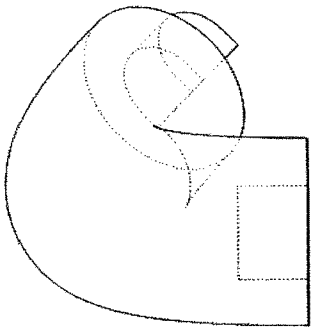
Figure 20I:
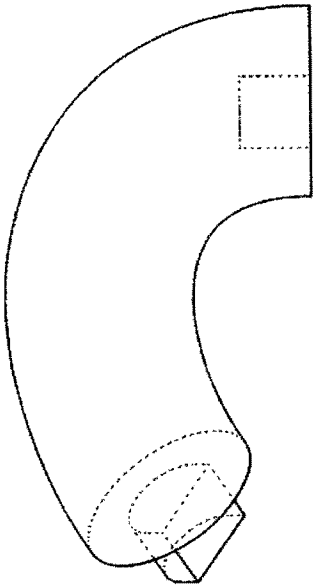

Referring to FIG. 20, the Z M/Fv1 push element 2000 has a mating surface 2001 and 2004 at each end of the piece, at an angle relative to one another as shown in FIG. 20ii. There are compound angles in the element 2000. The "Z" is used as a transition between two general planes at 90 degrees to each other, i.e. enables the 3D nature of this product. An engaging element 2002 with a flat face 2003 extends from the mating surface 2001. A complementary shaped receiving orifice 2005 having a flat surface 2006 is provided on the mating surface 2004 for mutual engagement of the pieces.

Figure 21I:
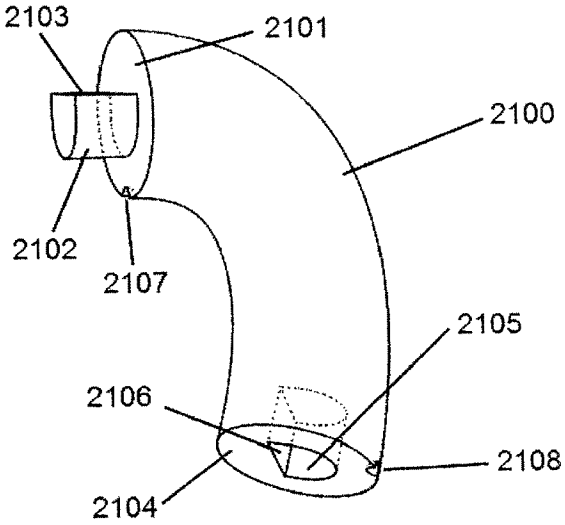
Figure 21I:
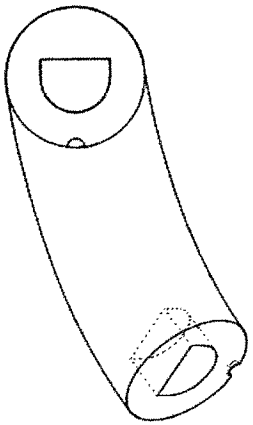
Figure 21I:
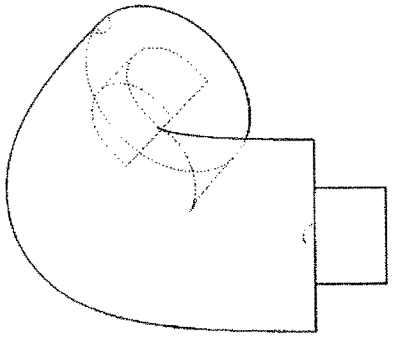
Figure 21I:
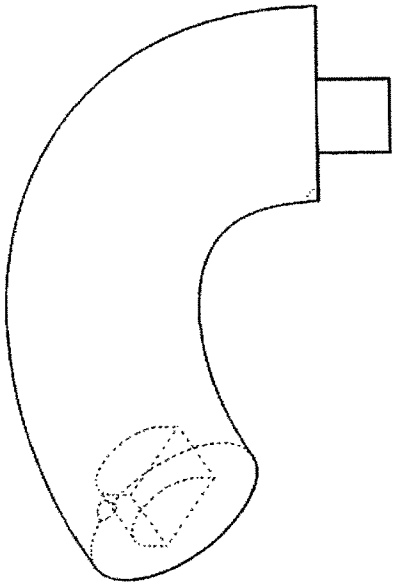
Figure 22I:
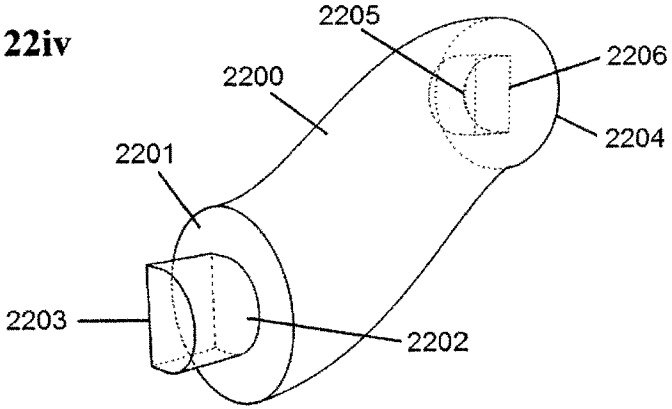
Figure 22I:
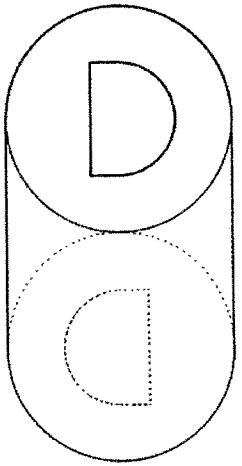
Figure 22I:
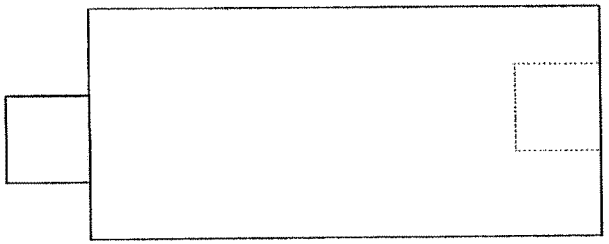
Figure 22I:
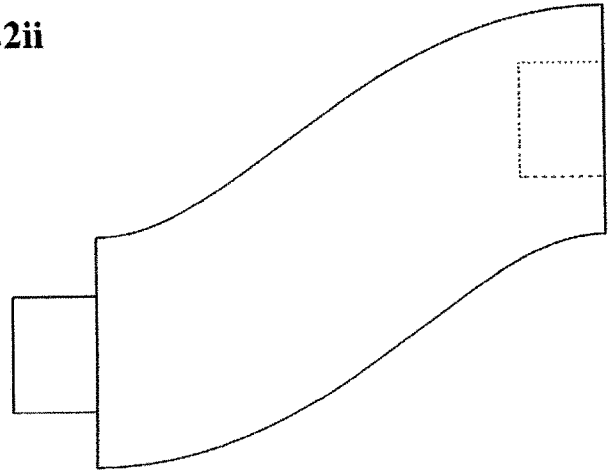
Figure 23I:
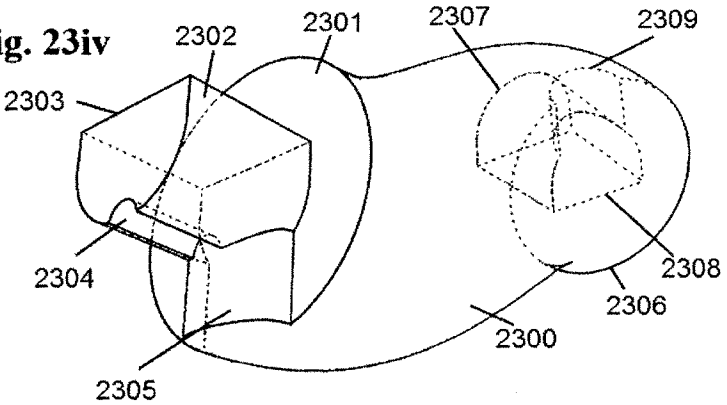
Figure 23I:
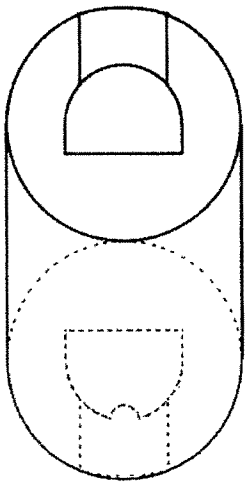
Figure 23I:
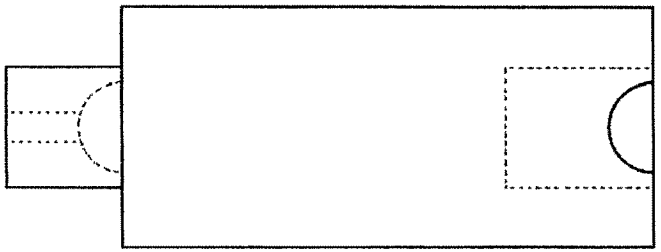
Figure 23I:
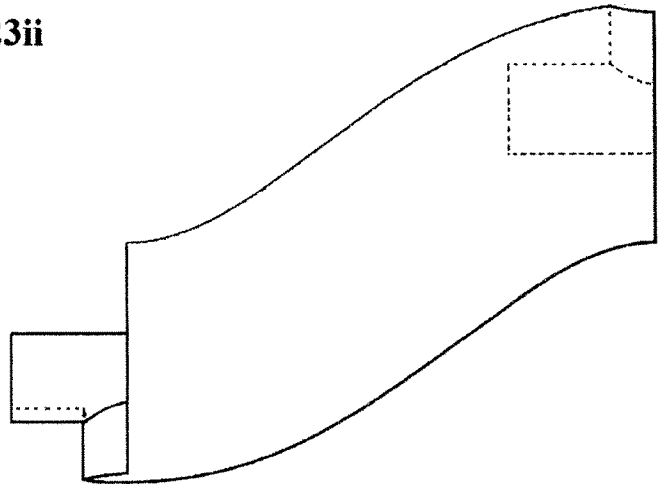

Referring to FIG. 21, the Zo M/Fv1 push element 2100 has a mating surface 2101 and 2104 at each end of the piece, at an angle relative to one another as shown in FIG. 21ii. There are compound angles in element 2100. These are used as transitions between two general planes at 90 degrees to each other, i.e. enables the 3D nature of this product. An engaging element 2102 with a flat face 2103 extends from the mating surface 2101. A complementary shaped receiving orifice 2105 having a flat surface 2106 is provided on the mating surface 2104 for mutual engagement of the pieces. A notch 2107 is provided on the mating surface 2101 and a corresponding notch 2108 is provided on the mating surface 2104. This is to differentiate the element from FIG. 20, the Z M/Fv1 push element, in which the engaging element and complementary shaped receiving orifice are reversed.

Referring to FIG. 22, the A M/Fv2 push element 2200 has a mating surface 2201 and 2204 at each end of the piece. An engaging element 2202 with a flat face 2203 extends from the mating surface 2201. A complementary shaped receiving orifice 2205 having a flat surface 2206 is provided on the mating surface 2204 for mutual engagement of the pieces.

Referring to FIG. 23, the A M/Fv3 push element 2300 has a mating surface 2301 and 2306 at each end of the piece. An engaging element 2302 with a flat face 2303, an air flute feature 2304 and engaging surface 2305 extends from the mating surface 2301. A complementary shaped receiving orifice 2307 having a flat surface 2308 and engaging surface 2309 is provided on the mating surface 2306 for mutual engagement of the pieces.

Figure 24I:
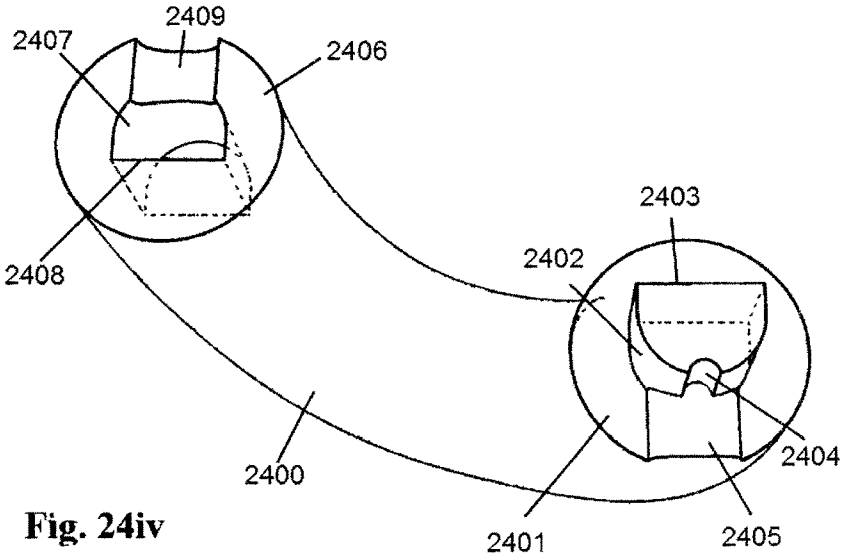
Figure 24I:
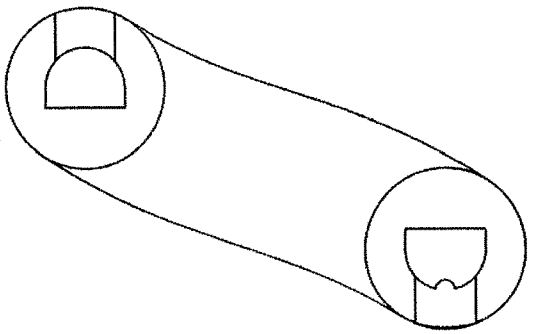
Figure 24I:
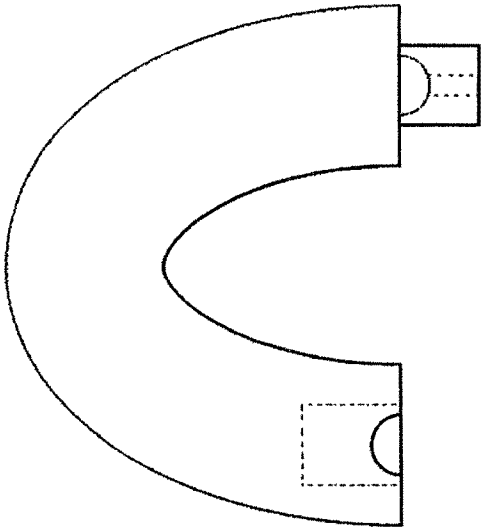
Figure 24I:
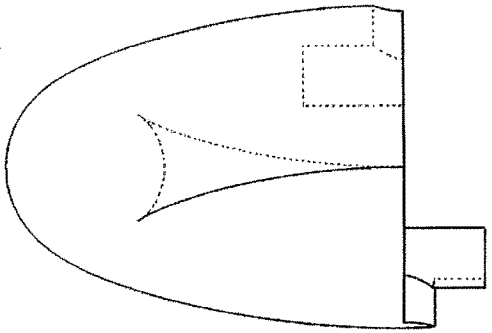
Figure 25I:
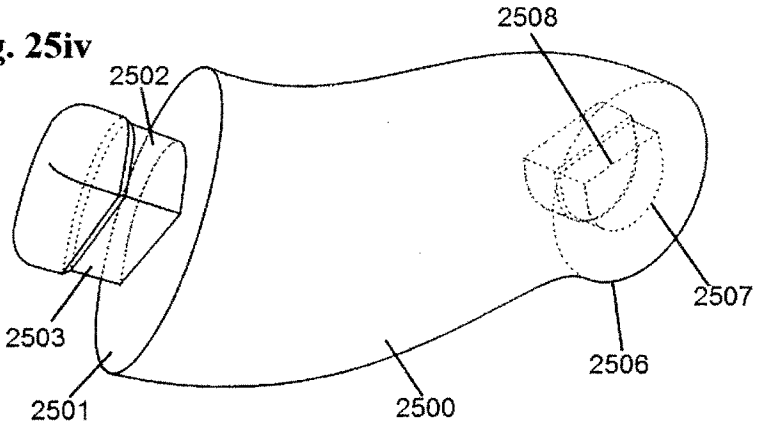
Figure 25I:
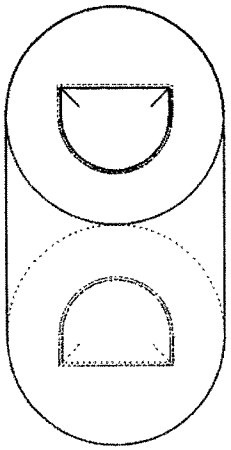
Figure 25I:
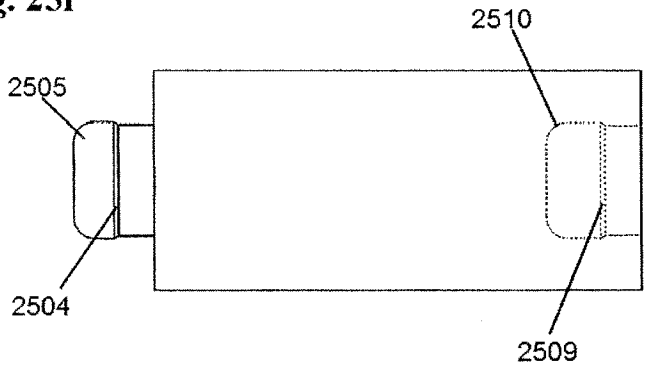
Figure 25I:
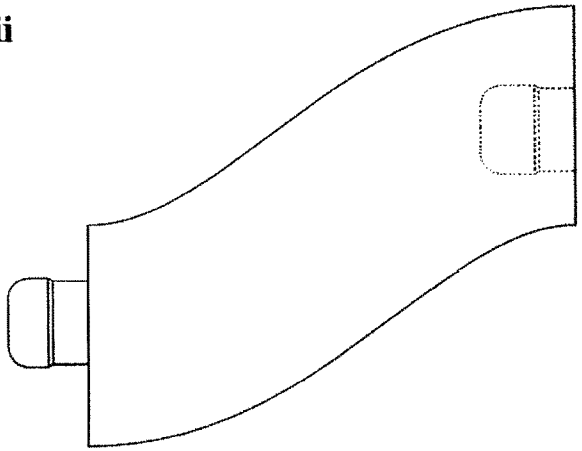
Figure 26I:
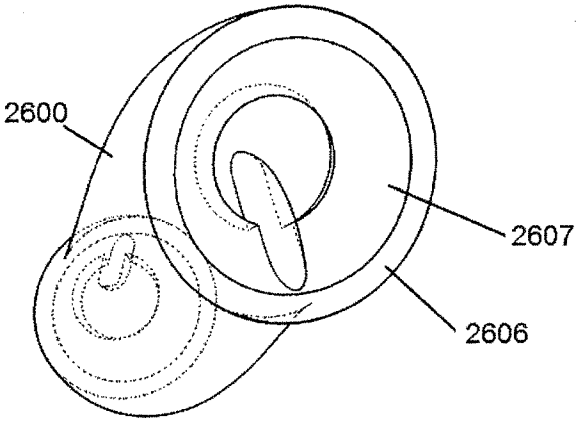
Figure 26I:
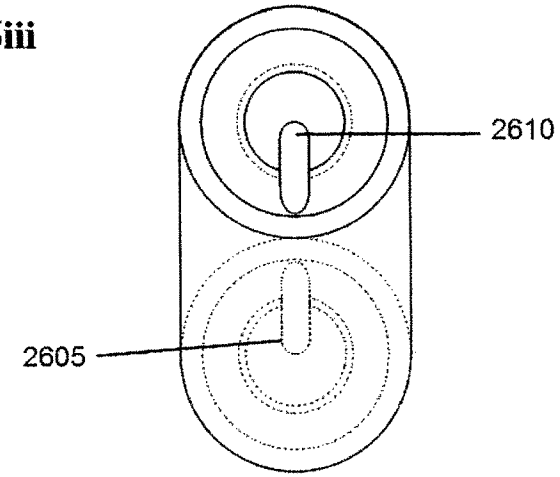
Figure 26I:
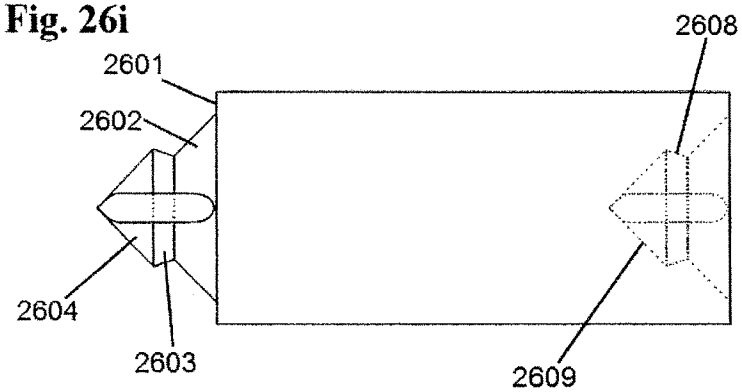
Figure 26I:
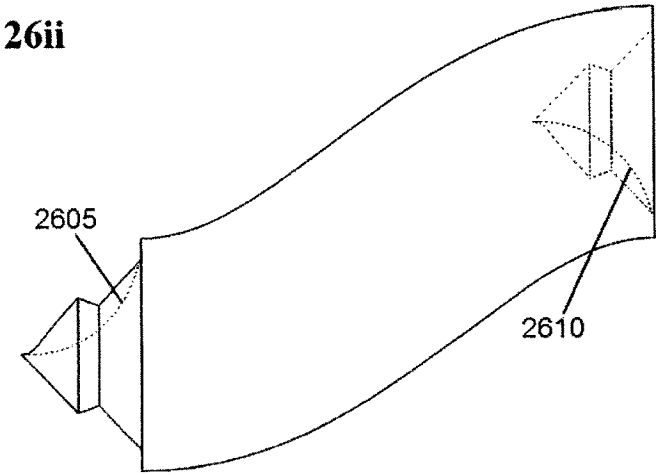

Referring to FIG. 24, the C M/Fv3 push element 2400 has a mating surface 2401 and 2406 at each end of the piece at 180 degrees relative to one another as shown in FIG. 24i. An engaging element 2402 with a flat face 2403, an air flute feature 2404 and engaging surface 2405 extends from the mating surface 2401. A complementary shaped receiving orifice 2407 having a flat surface 2408 and engaging surface 2409 is provided on the mating surface 2406 for mutual engagement of the pieces.

Referring to FIG. 25, the A M/Fv4 snap element 2500 has a mating surface 2501 and 2506 at each end of the piece. An engaging element 2502 with a flat face 2503 enlarged snap end 2505 with a sloped surface 2504 extends from the mating surface 2501. A complementary shaped receiving orifice 2507 having a flat surface 2508 with enlarged snap enclosure 2510 with a sloped surface 2509 is provided on the mating surface 2506 for mutual engagement of the pieces.

Referring to FIG. 26, the A M/Fv5 snap element 2600 has a mating surface 2601 and 2606 at each end of the piece. An engaging element 2602 with a conical head 2604 and sloped surface 2603 extends from the mating surface 2601. A complementary shaped receiving orifice 2607 having a conical enclosure 2609 and sloped surface 2608 is provided on the mating surface 2606 for mutual engagement of the pieces. A notch 2605 is provided on the mating surface 2601 and a corresponding notch 2610 is provided on the mating surface 2606 to assist in lining up similar pieces in the correct orientation.

Referring to FIG. 27 which is six separate views of the part 1 assembly, with the A M/Fv1 push element 2700 shown in FIGS. 27i and 27ii. The "B" push elements are labelled 2701 in FIG. 27iii and in FIG. 27iv the "Bo" push elements are numbers 2702. The "C" push elements are labelled 2703 in FIG. 27v and in FIG. 27vi the "Co" push element is numbered 2704.

Assembly Part 2 is shown in FIG. 28 with the "D" push element being labelled 2800 in FIG. 28i. The "Do" push element 2801 is shown in FIG. 28ii and the "E" push element 2802 is shown in FIG. 28iii. Two "F" push elements 2803 are shown in FIG. 28iv and one "S" push element 2804 is shown in FIG. 28v.

Part 3 of the assembly is shown in FIG. 29 with the "T" push elements 2900 being shown in FIG. 29i and one "U" push element 2901 shown in FIG. 29ii. In FIG. 29iii the push element "Uo" is labelled as 2902 and three "Y" push elements 2903 are shown in FIG. 29iv. In FIG. 29v the push elements "Z" are labelled as 2904.

The underlying principles of both versions will now be described in detail.

As a basic example, not limited in any way, more complex structures are possible, there are four core pieces that create Celtic knotwork or weaving patterns in a single general plane; 'A' is a straight (0 degrees), 'B' is a quadrant (90 degrees), 'C' is a U-bend (180 degrees) and 'D' is a loop (270 degrees)—this is from the top or plan view. Looking from the front or side view, each piece also has a side profile that looks like a "stretched out half a sine wave/curve" which is stretched around each top profile. The distance the side profile drops is equivalent to the diameter of the piece. This is not limited to 90 degree angled pieces, other angles are also possible, for instance the 60 degree angled piece, see FIG. 46.

There are different ways that the 'D' may be produced. In order for it to be injection moulded in one piece, the two ends can be joined in order to prevent the undercutting, as in FIG. 12. Without this, the 'D' must be produced in two pieces. One embodiment of this is shown in FIG. 34, whereby a different arrangement of male and female lugs on each end is used so that a duplicate piece is used, by rotating it through 180 degrees, to attach to the aforementioned lugs.

These pieces use an underlying grid of imaginary squares and lattices on which to orientate themselves on. Each of the squares' edges are bisected, and these points are then joined to form a smaller square, rotated at 45 degrees, within the large square. A's use one of these small square edges. B's use two small square edges. C's use three small square edges. D's use all four small square edges.

This configuration of pieces has a circular cross section, but this is not absolutely necessary; any cross section which can be manufactured within reason will do.

Pieces A-F produce knots in two dimensional planes, although weaving under and over each other they create a three dimensional result; this is still limited to a general or single plane. By this is meant a single plane within certain limits. However, T's, U's, Y's and Z's are used as transitions between two planes at 90 degrees to each other; they are used differently though. Y's and Z's are used in the transitions between planes which are folded through 90 degrees along the edges of the large underlying grid of imaginary squares. T's and U's are used in the transitions between planes which are folded through 90 degrees along the edges of the small underlying grid of imaginary squares. Many more complex and interesting knots may be made with these 'folding' pieces, such as cubes etc. Other mirrored and more complex pieces at different angles may be used in knots in various planes.

By default, all the pieces (except A) bend round to the right (from the top view), starting from the highest end, and then end at the lower position as the strand appears to go under another two joined pieces. When left bends are used, these are suffixed with an 'o', e.g. B is right, and Bo is left. So, for ease of recognition, these pieces are discreetly marked with a dot on each end for instance, showing the user this is a left hand piece, but this is purely cosmetic. In fact, the 'o' denotes the mirror image, so in more complex pieces, the 'o' will distinguish between the F (right, left, right) and Fo (left, right, left) for instance. Note, it is possible to mix right and left handed pieces in the same knots. Everything here may be mirrored and it is still valid.

The S piece is used to blank off one end so that a player can only add more pieces to the remaining one 'exposed' end. This is particularly useful if the player is following a sequence of pieces from instructions for instance.

Any of the pieces may be combined with any others to form longer sections. The internal joints will be omitted, but the joints at each end will still be needed, see FIGS. 4, 6 and 14. These drawings show the M/Fv1 format, but equally well could be made with any other format joints, including F/F.

The first version M/F will now be described in detail.

Each piece (except those marked with a '+' or '−') has one engaging element at one end and a complementary shaped receiving orifice at the other end. These joints may either be produced with a push fit or a snap fit, but only one type of fit is to be used in a marketed version to standardise the pieces. The engaging element is a one way lug, i.e. may only be fitted one way round into a complementary shaped receiving orifice. The important thing is that, whichever way round the engaging element is orientated, the complementary shaped receiving orifice is rotated through 180 degrees at the other end of the piece. This can be seen clearly with all v1 pieces; the flat part of the engaging element is on top (or the convex 'outer' side of one end) whilst the complementary shaped receiving orifice flat is on the bottom. But if the whole piece is rotated through 180 degrees the complementary shaped receiving orifice flat then corresponds with the engaging element flat.

The pieces fit male to female all the way round any desired pattern. The drawing shows a push fit lug with the flats on the top and bottom, but they could equally well be on the inside (each rotated 180 degrees) or the side (each rotated 90 degrees). Also, any form of one way joint is suitable if able to be manufactured; a few alternatives are shown on other drawings.

The reason why the male and female lugs are rotated 180 degrees to each other is that this forces the strands produced to undulate alternately up and down to produce the 'knot' or 'woven' type patterns. If the joints were made universal, not one way round but circular in section for instance, a user could fit them altogether in a strand, but when it came to 'weaving' them together, the user would have to disconnect some (the majority more than likely) to orientate them and position them in a way that they 'weave'; this is very clumsy, but would still work.

The A+ has two male joints, whilst the A− has two female joints. Note, connecting an A+ to an A−, the overall result will be the same as connecting two A's together.

The reason for these '+' and '−' pieces is that they are used to correct mistakes or redirect strands of knots so that a user does not have to completely dismantle a knot. If the user is in a position where two different strands meet each other head on with the same "polarity" of ends, the user may insert the relevant '+' or '−' piece to connect them. It is then required that one of the other unconnected ends of the now same strand is fitted with an opposite polarity piece to correct that end, i.e. they are always used in pairs.

Detailed Description of Female/Female (F/F) Version

Referring now to FIG. 30, the A F/Fv1 push element 3000 has a mating surface 3001 at each end which each have a receiving orifice 3002 with a flat surface 3003 and a locating notch 3004 turned through 180 degrees.

Figure 31I:
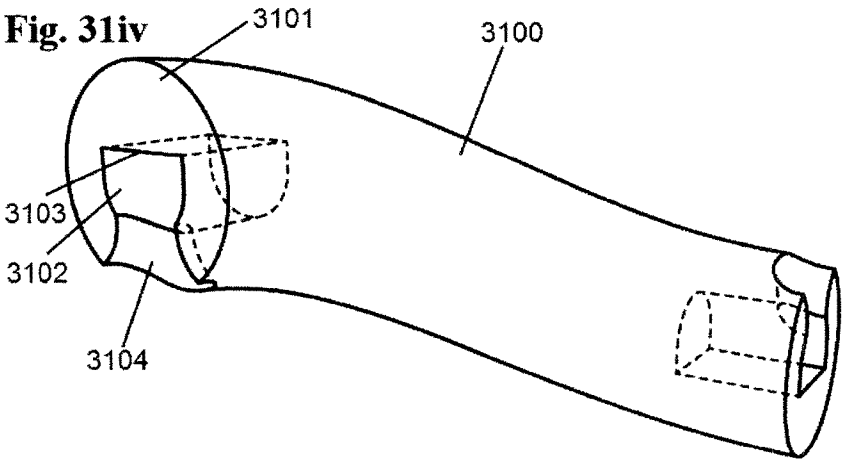
Figure 31I:
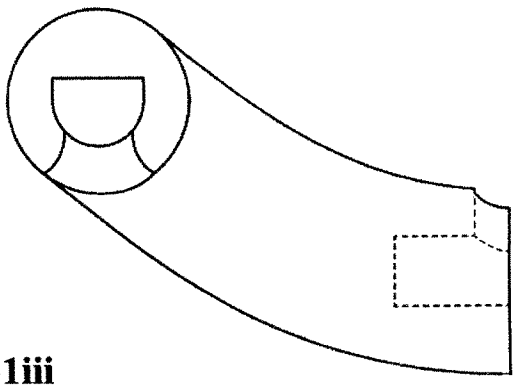
Figure 31I:
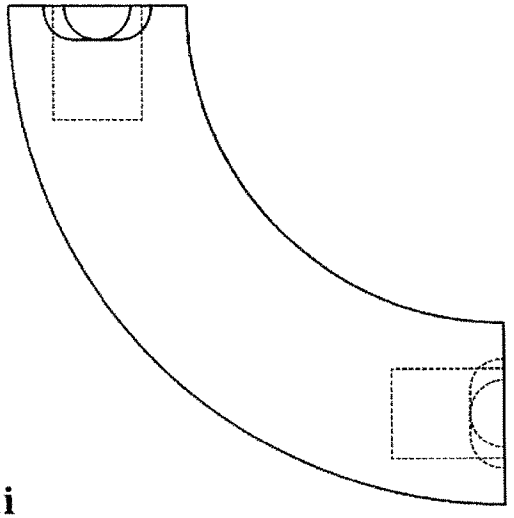
Figure 31I:
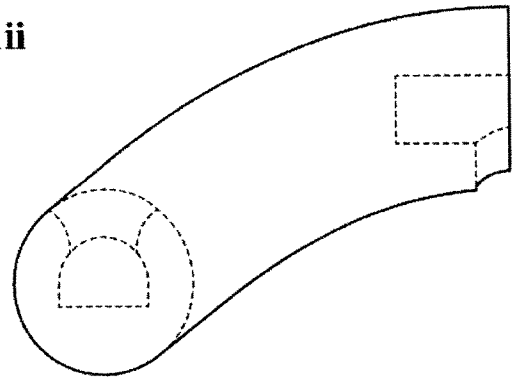

Referring to FIG. 31, the B F/Fv1 push element 3100 has a mating surface 3101 at each end of the piece, at 90 degrees relative to one another as shown in FIG. 31i. Each mating surface 3101 has a receiving orifice 3102 with a flat surface 3103 and a locating notch 3104 turned through 180 degrees.

Figure 32I:
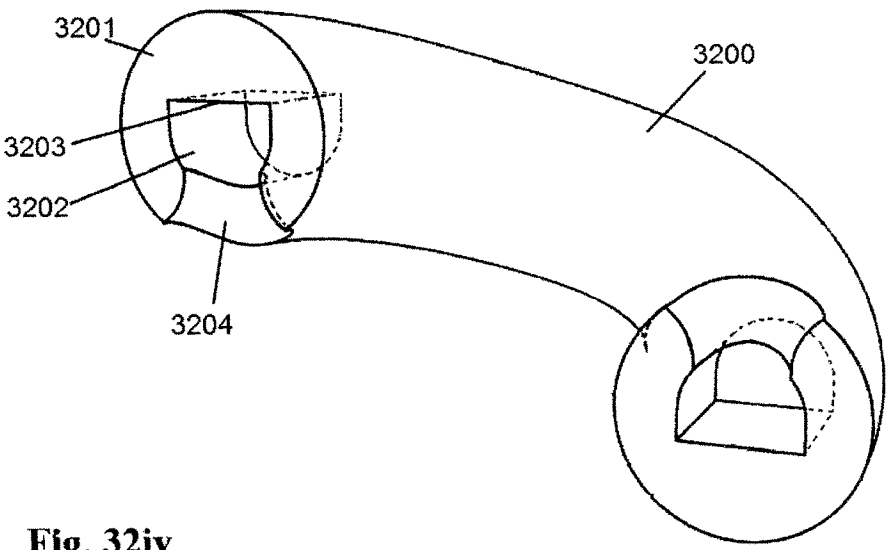
Figure 32I:
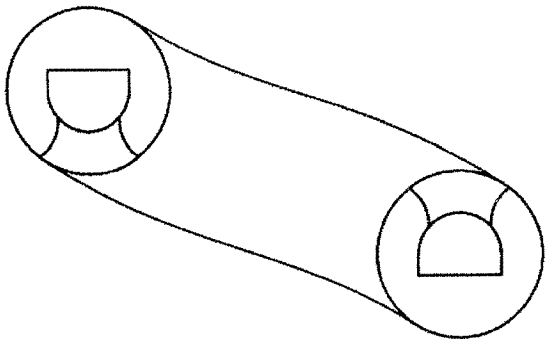
Figure 32I:
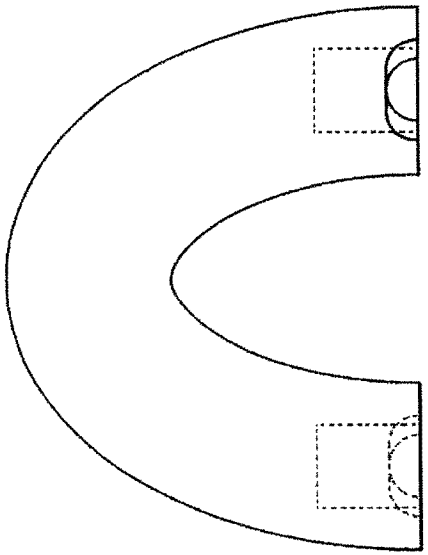
Figure 32I:
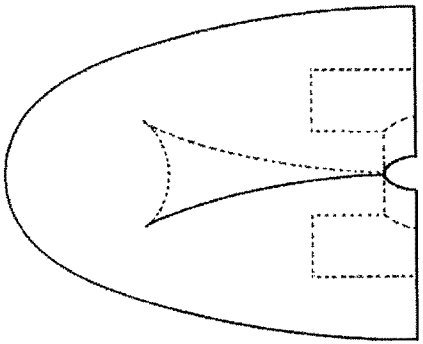

Referring to FIG. 32, the C F/Fv1 push element 3200 has a mating surface 3201 at each end of the piece, at 180 degrees relative to one another as shown in FIG. 32i. Each mating surface 3201 has a receiving orifice 3202 with a flat surface 3203 and a locating notch 3204 turned through 180 degrees.

Figure 33I:
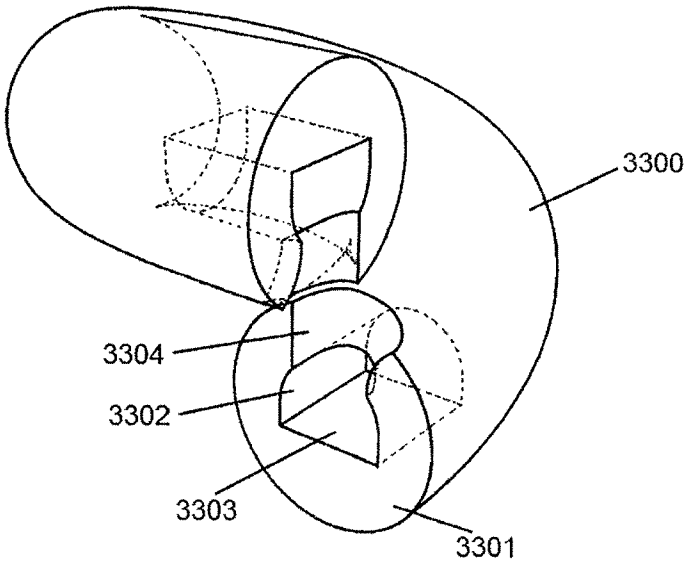
Figure 33I:
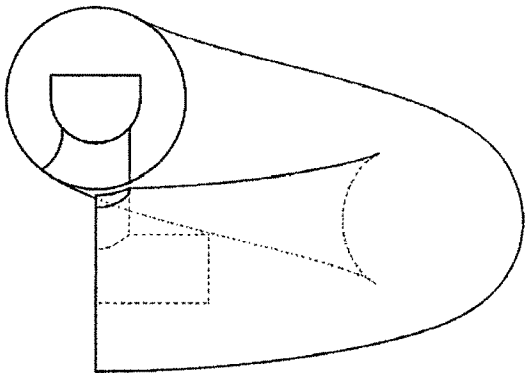
Figure 33I:
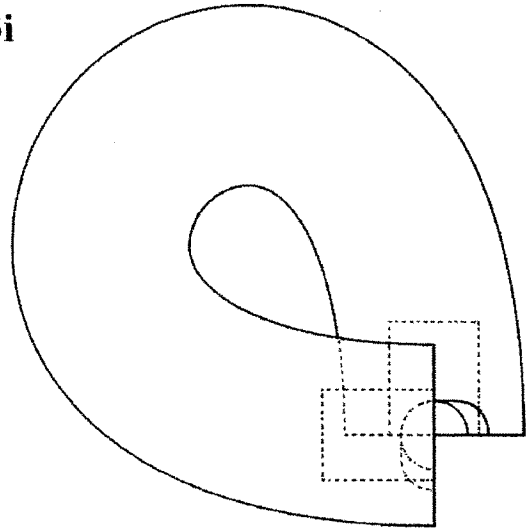
Figure 33I:
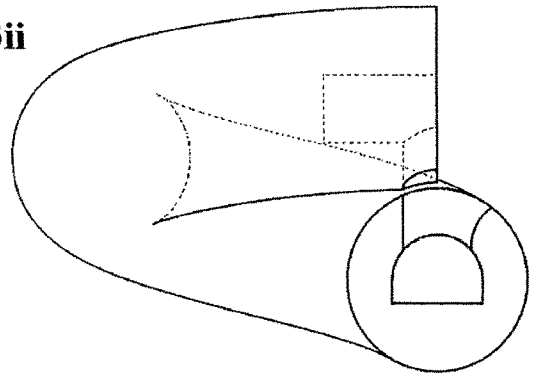
Figure 34I:
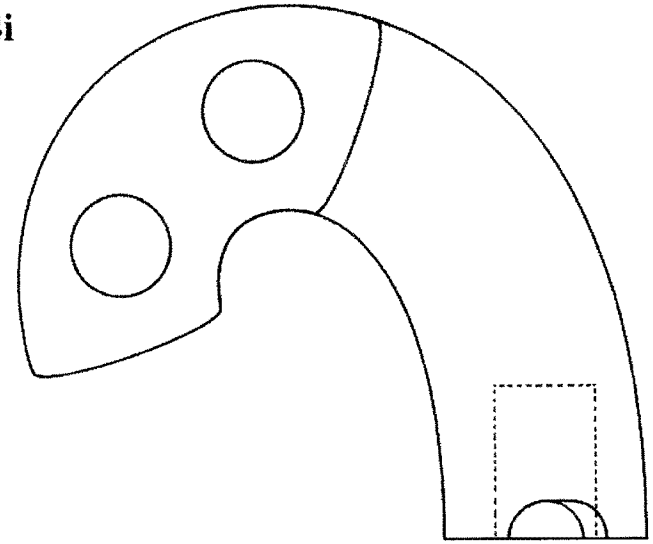
Figure 34I:
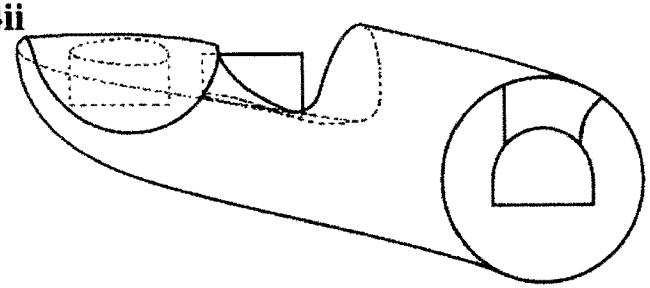
Figure 34I:
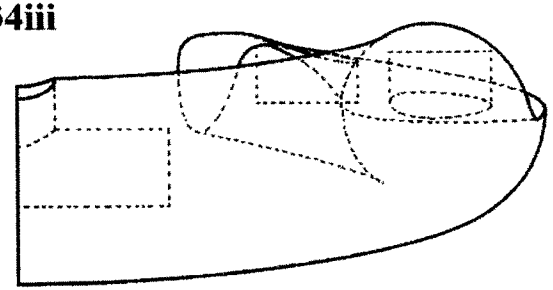
Figure 34I:
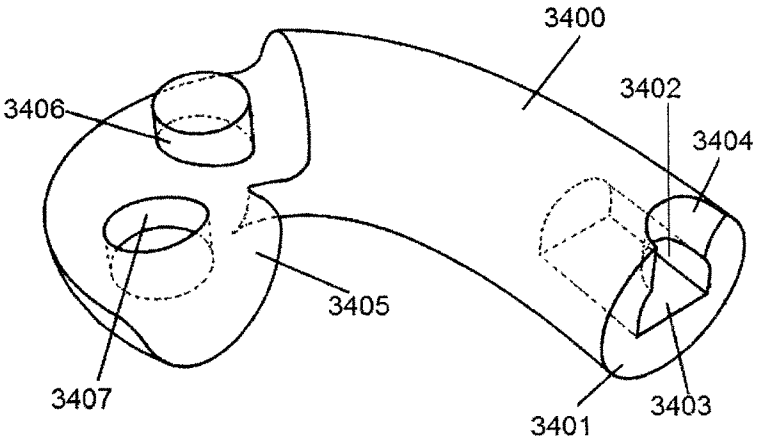
Figure 35I:
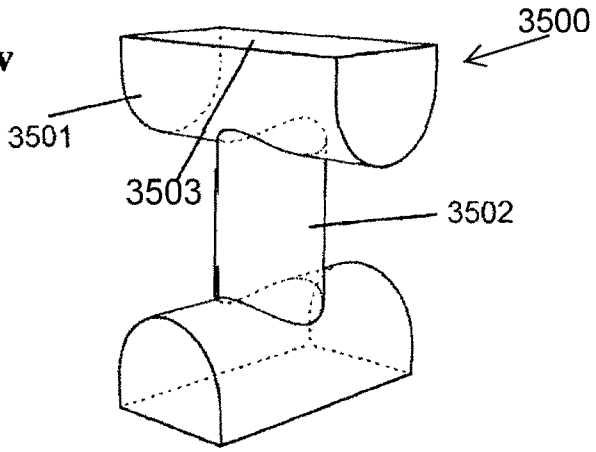
Figure 35I:
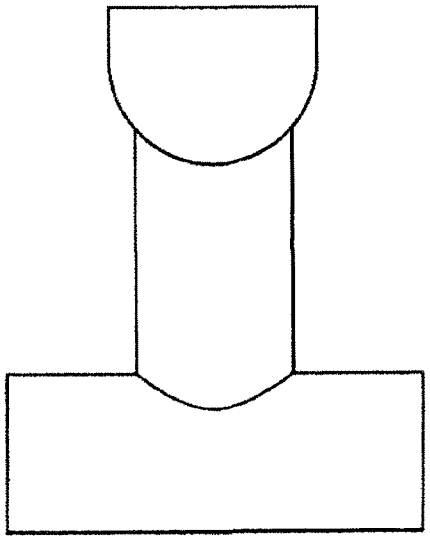
Figure 35I:
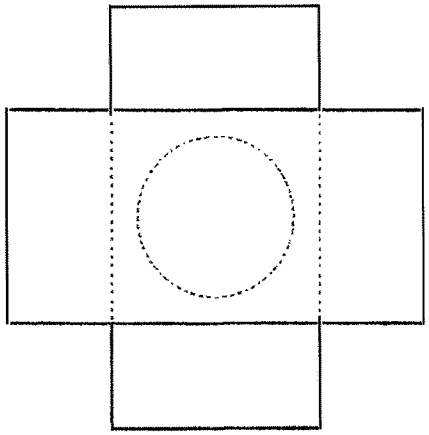
Figure 35I:
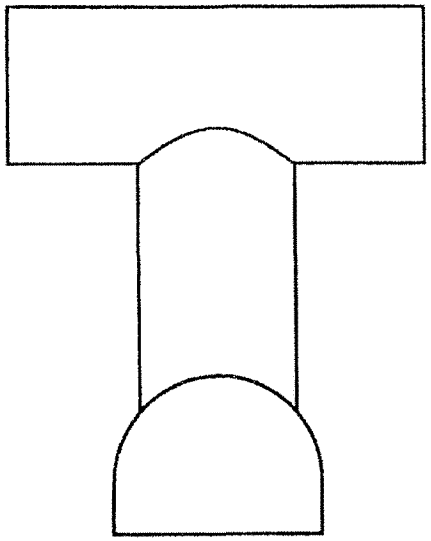
Figure 36I:
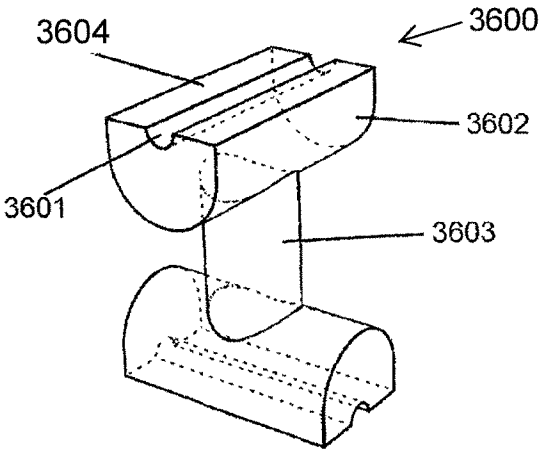
Figure 36I:
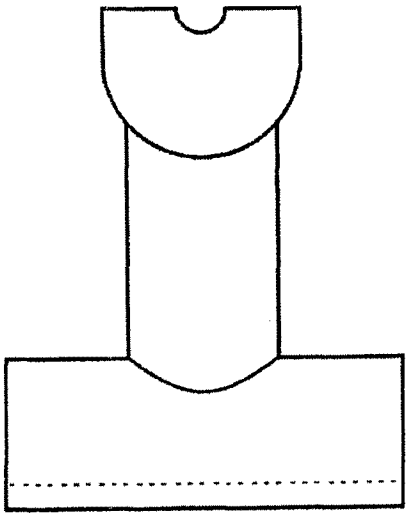
Figure 36I:
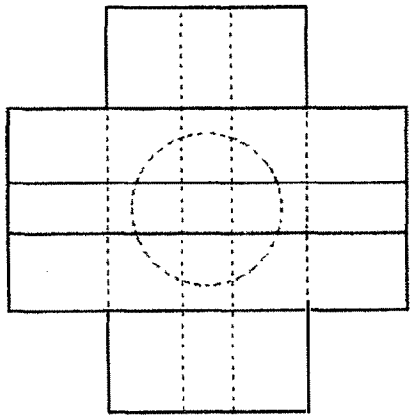
Figure 36I:
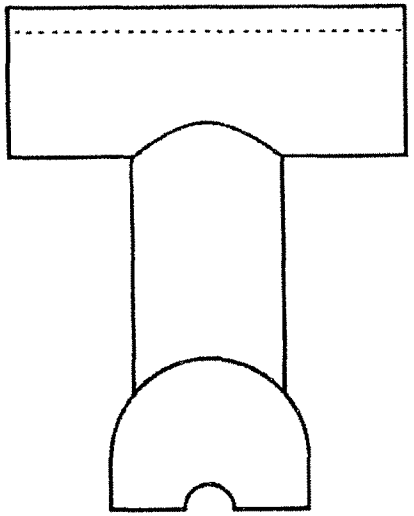
Figure 37I:
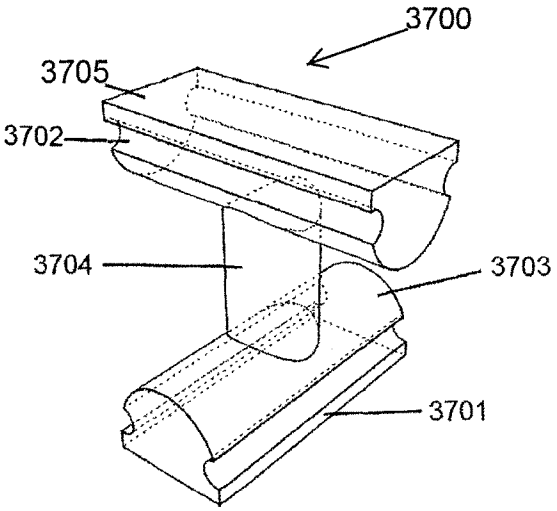
Figure 37I:
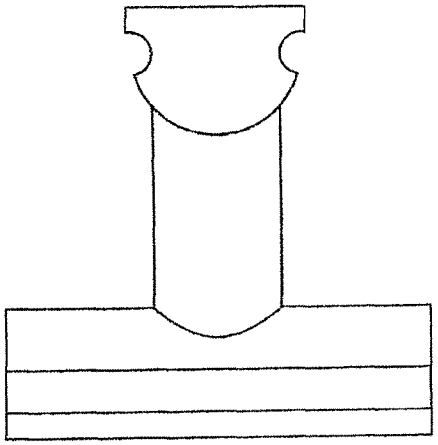
Figure 37I:
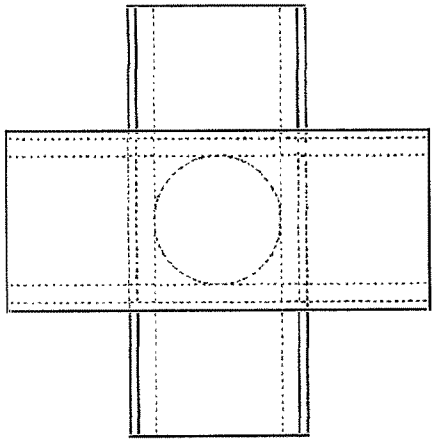
Figure 37I:
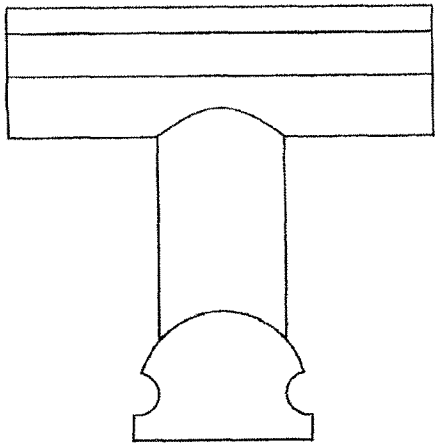
Figure 38I:
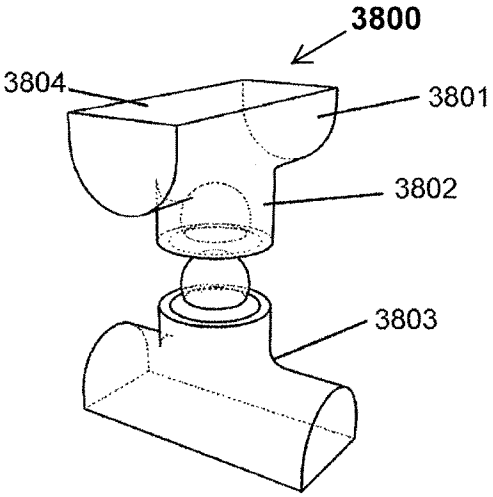
Figure 38I:
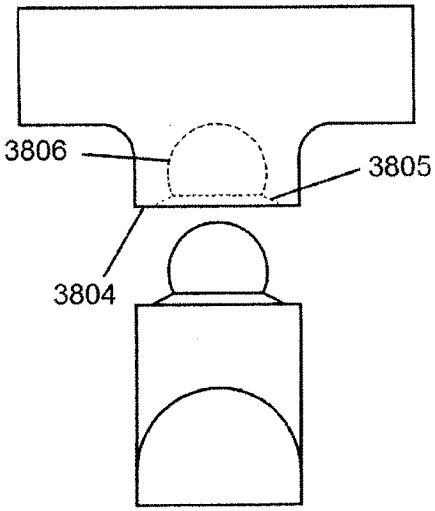
Figure 38I:
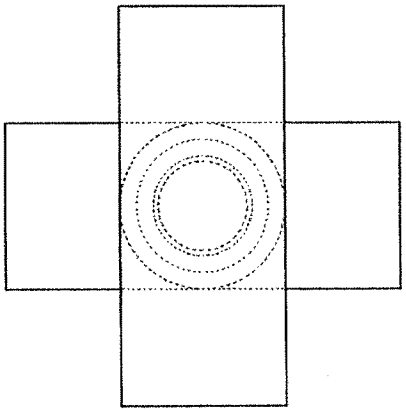
Figure 38I:
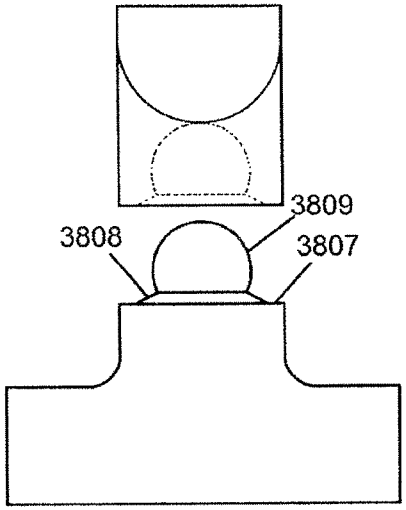
Figure 39I:
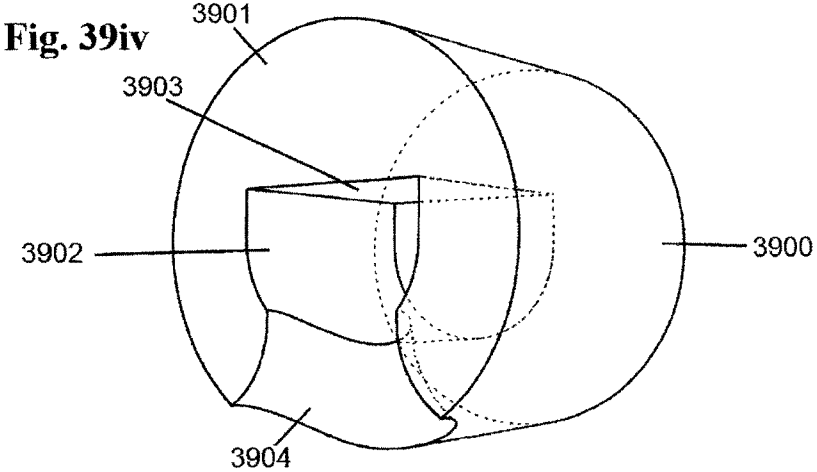
Figure 39I:
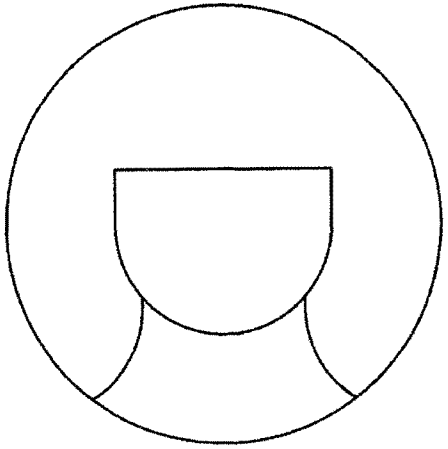
Figure 39I:
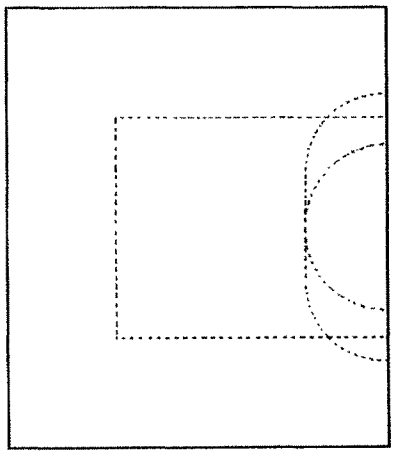
Figure 39I:
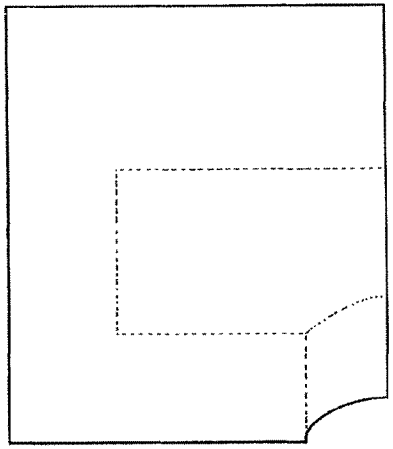
Figure 40I:
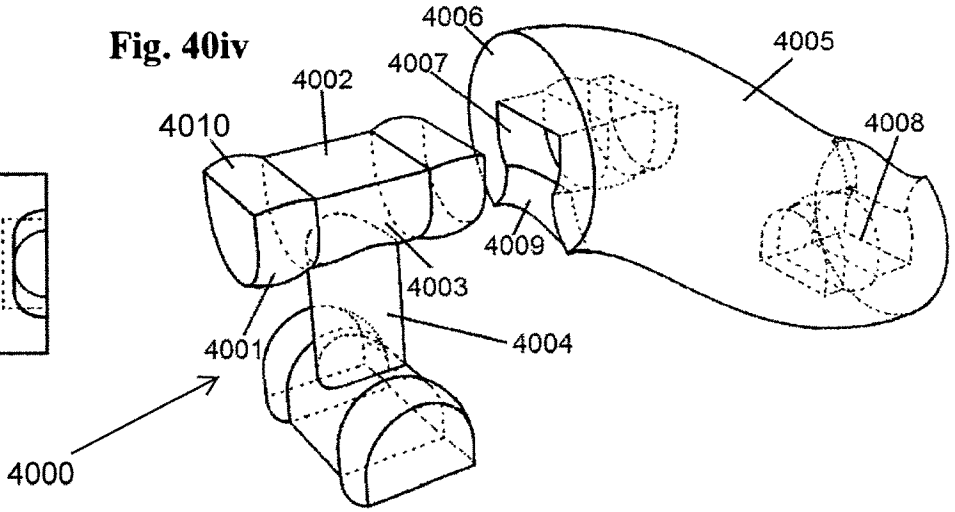
Figure 40I:
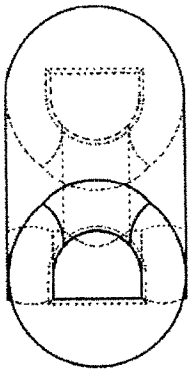
Figure 40I:
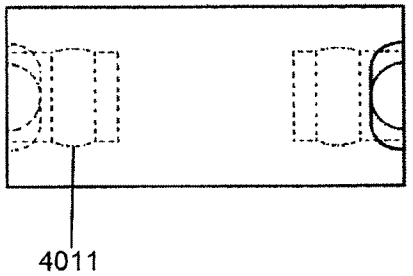
Figure 40I:
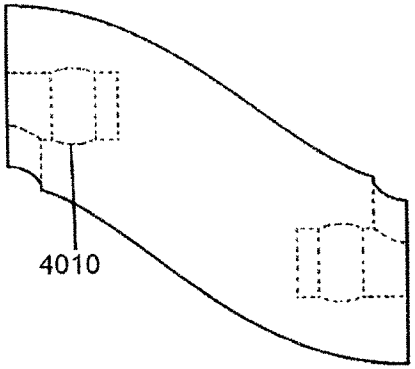
Figure 42I:
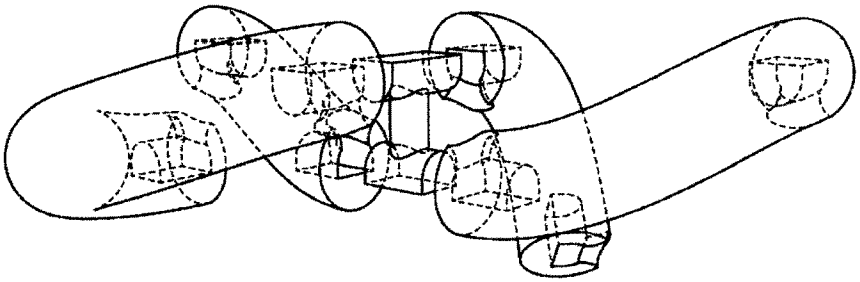
Figure 42I:
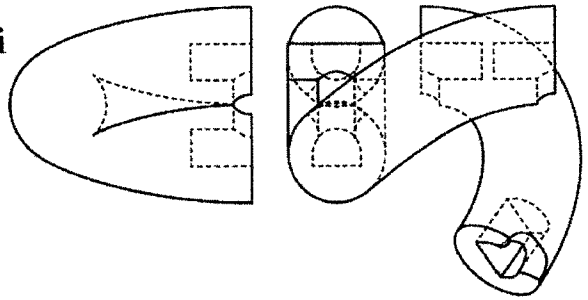
Figure 42I:
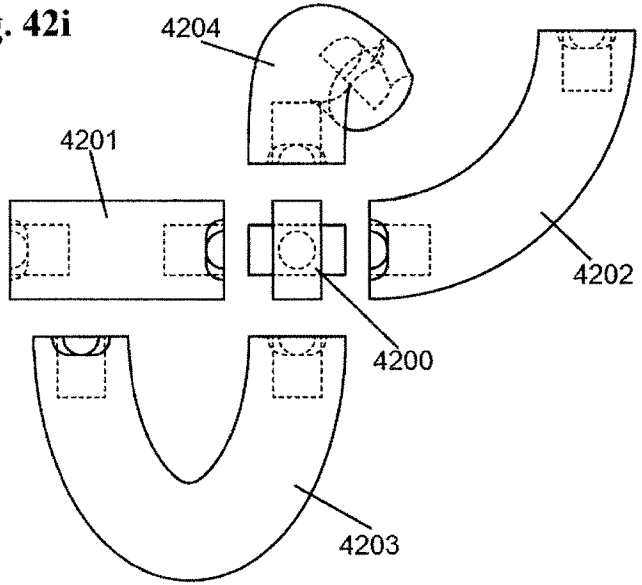
Figure 42I:
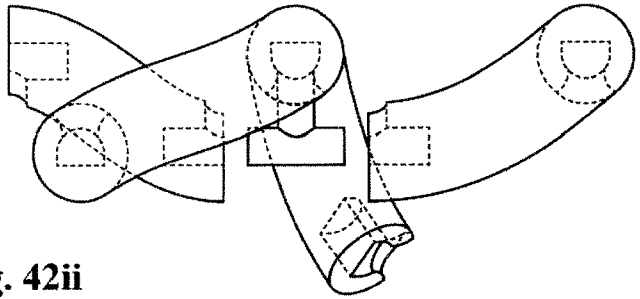
Figure 43I:
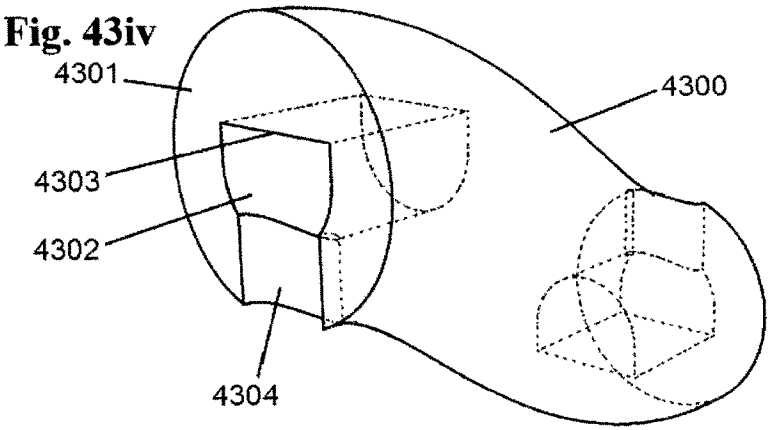
Figure 43I:
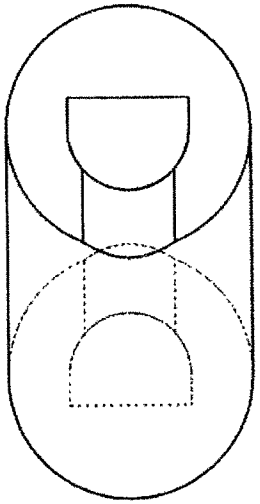
Figure 43I:
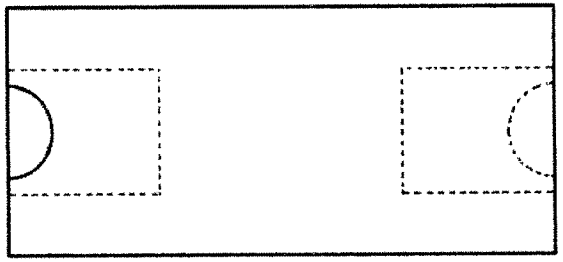
Figure 43I:
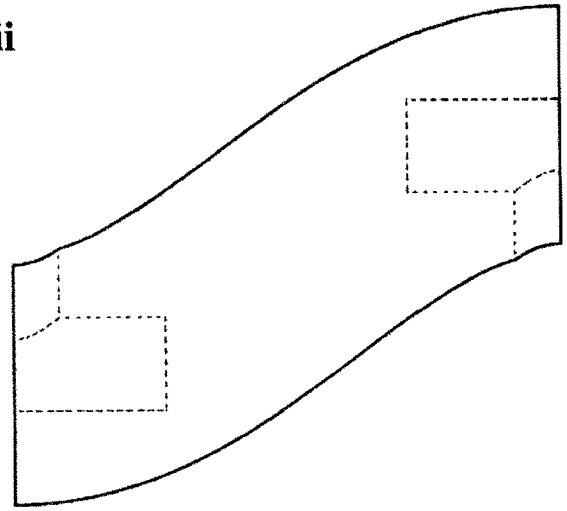
Figure 44I:
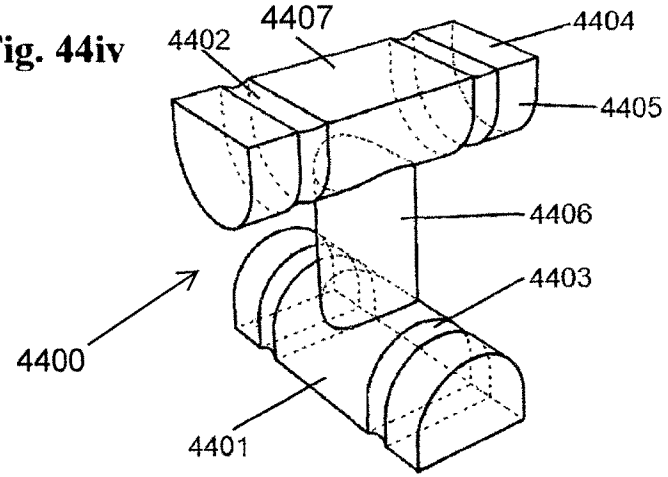
Figure 44I:
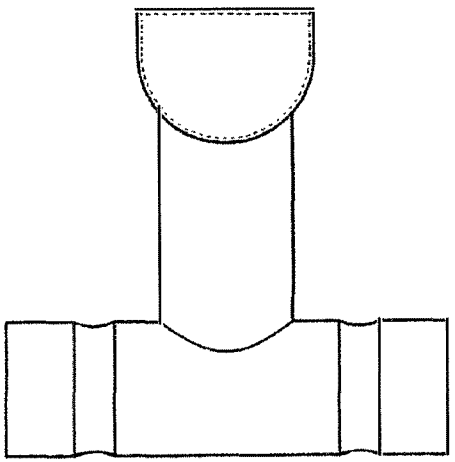
Figure 44I:
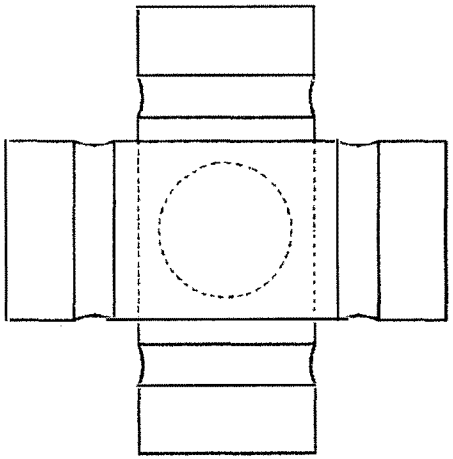
Figure 44I:
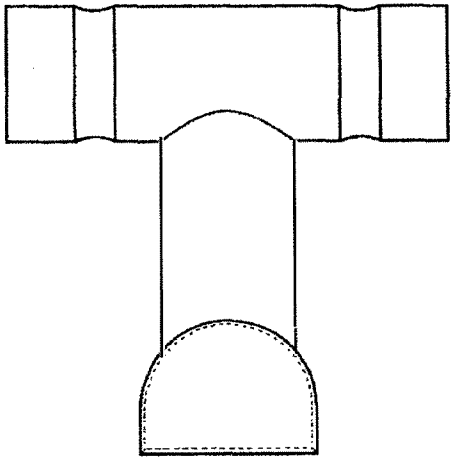

Referring to FIG. 33, the D F/Fv1 push element 3300 has a mating surface 3301 at each end of the piece, at 270 degrees relative to one another as shown in FIG. 33i. Each mating surface 3301 has a receiving orifice 3302 with a flat surface 3303 and a locating notch 3304 turned through 180 degrees.

Referring to FIG. 34, the D F/Fv1 push split element 3400 has at one end a mating surface 3401 provided with a receiving orifice 3402 with a flat surface 3403 and a locating notch 3404. At the other end of the element 3400 is a transverse mating surface 3405 having a locating peg 3406 and a corresponding shaped orifice 3407.

Referring to FIG. 35, the Jv1 F/Fv1 push element 3500 comprises two laterally disposed locators 3501 separated by a barrel section 3502, and flat surfaces 3503 which correspond to the flat surfaces in the F/F pieces.

The Jv2 F/Fv1 push element 3600 is shown in FIG. 36 and comprises two laterally disposed locators 3602 separated by a barrel section 3603. Each locator 3602 is provided with a flat surface 3604 and a longitudinal channel 3601.

Referring to FIG. 37, the Jv3 F/Fv1 push element 3700 comprises two laterally disposed locators 3701 separated by a barrel section 3704. Each locator 3701 is provided with a flat surface 3705 and a pair of longitudinal transverse channels 3702.

Referring to FIG. 38, the Jv4 F/Fv1 push element 3800 is a two part component joined by a ball and socket coupling. The push element 3800 comprises two locators 3801 each with flat surfaces 3804, barrel sections 3802 and filleted surfaces 3803. The lower barrel 3802 has a mating surface 3807 having a ball 3809 on a sloped surface 3808. The upper barrel is 3802 inside which is a complementary shaped socket 3806 a sloped surface 3805 and a mating surface 3804.

Referring to FIG. 39 the S F/Fv1 push element 3900 has a mating surface 3901 which is provided with a receiving orifice 3902 with a flat surface 3903 and a locating notch 3904.

Referring to FIG. 40 the A and J F/Fv2 snap elements are 4000 which is a connector and 4005 which is an "A" piece. The snap element 4000 comprises two laterally disposed locators 4003 with flat surfaces 4002 separated by a barrel section 4004. Each locator 4003 has a pair of bulbous snap ends 4001 and 4010. The second snap element 4005 which is an "A" piece has two mating surfaces 4006. Each mating surface 4006 has a complementary shaped receiving orifice 4007 and a locating notch 4009 turned through 180 degrees.

Referring to FIG. 41 the A and J F/Fv3 push elements are 4100 which is a connector and 4102 which is an "A" piece. The push element 4100 comprises two laterally disposed cylindrical locators 4106 separated by a barrel section 4101. The second push element 4102 which is an "A" piece has two mating surfaces 4103. Each mating surface 4103 has a complementary shaped receiving orifice 4104 and a locating notch 4105 turned through 180 degrees.

Referring to FIG. 42, which shows an exploded assembly F/Fv1 push elements, four separate elements 4201, 4202, 4203 and 4204 will all connect together using the centrally disposed connector 4200.

Referring to FIG. 43, the A F/Fv4 push element 4300 has a mating surface 4301 at each end of the piece. Each mating surface 4301 has a receiving orifice 4302 with a flat surface 4303 and a locating notch 4304 turned through 180 degrees.

Referring to FIG. 44, the J F/Fv5 snap element 4400 comprises two laterally disposed locators 4401 separated by a barrel section 4406. Each locator 4401 is provided with a transverse channel 4402 at each end, a flat surface 4407 and a circumferential channel 4403 in order to provide the required snap function.

Figure 45I:
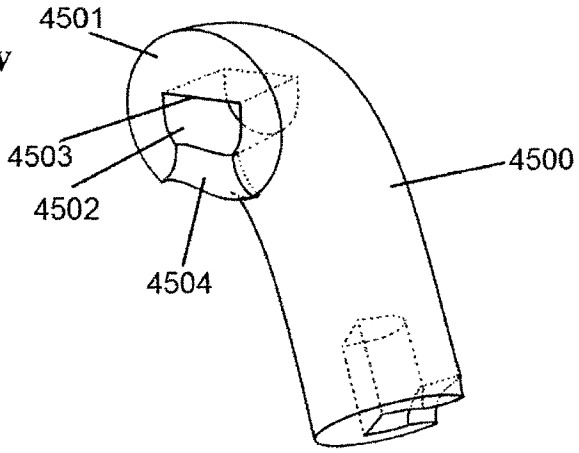
Figure 45I:
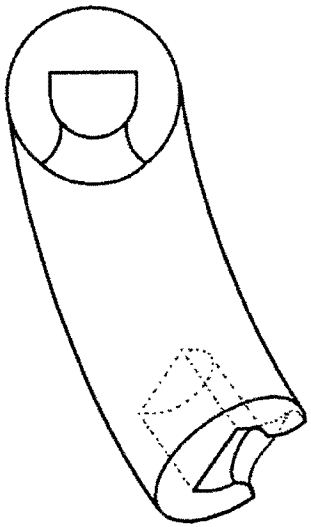
Figure 45I:
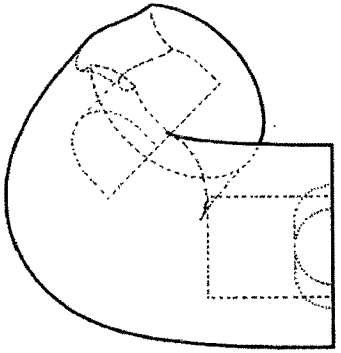
Figure 45I:
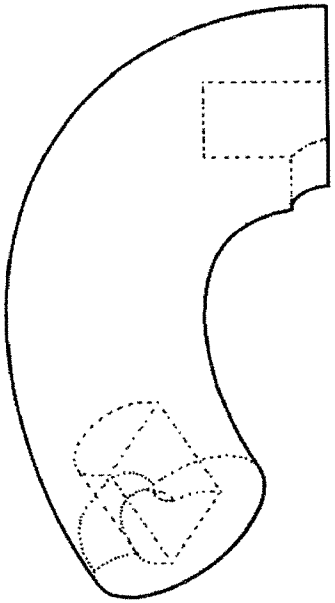

Referring to FIG. 45, the Z F/Fv1 push element 4500 has a mating surface 4501 at each end of the piece, at an angle relative to one another as shown in FIG. 45ii. There are compound angles in the element 2000. Each mating surface 4501 has a receiving orifice 4502 with a flat surface 4503 and a locating notch 4504 turned through 180 degrees Referring to FIG. 46, the 60D F/Fv4 push element 4600 has a mating surface 4601 at each end of the piece, at 60 degrees relative to one another as shown in FIG. 46i. Each mating surface 4601 has a receiving orifice 4602 with a flat surface 4603 and a locating notch 4604 turned through 180 degrees. The corner 4605 corresponds to the filleted section 3803 of the ball and socket two part component 3800 as shown in FIG. 38.

Finally, referring to FIG. 47, the non-round A F/Fv1 push element 4700 has a mating surface 4701 at each end of the piece. Each mating surface 4701 has a receiving orifice 4702 with a flat surface 4703 and a locating notch 4704 turned through 180 degrees.

The second version F/F will now be described in detail.

Each main piece has two receiving orifices, one at each end. The flat (or other such 'key') in each receiving orifice is always orientated in the same way to each end, i.e. on top (or the convex 'outer' side of one end). There is also a hemispherical channel in each mating surface which widens out as it reaches the concave 'underside' of each end. This channel is to house the barrel section of the male connector unit, see below. The reason why the hemispherical channel widens out is to allow the male connector unit to flex in order to reach the receiving orifices. Note, the connectors themselves do not have to be one way, as the barrel section of the male connector unit acts as the key to make the joint fit only one way, see FIG. 41.

Alternatively, if rigid male connector units are used, there is no need for the hemispherical channel to widen out, see FIGS. 43, 46 and 47.

There are also separate male connector units which comprise two double ended pairs of male lugs. The first pair of male lugs connect with complementary shaped receiving orifices in two pieces. The second pair of male lugs is rotated through 90 degrees to the first, rotated through 180 degrees along its axis, then offset and joined with a barrel section to the first. This second pair of male lugs also connect with complementary shaped receiving orifices in two pieces. Thus each male connector unit joins with up to four main pieces and holds them together, unlike the first embodiment.

In order to accommodate pieces using angles other than 90 degree increments, there is one version of the male connector which is made in two parts with a ball and socket that joins both together. This allows it to swivel in the closed position to accommodate any angle, see FIG. 38.

The connectors may either be produced with a push fit or a snap fit, but only one type of fit is to be used in a marketed version to standardise the pieces.

It is to be understood that the invention is not limited to the specific details which are described herein and that various modifications and alterations are possible without departing from the scope of the invention as defined in the appended claims.

The invention claimed is:

1. An apparatus for playing a game, the apparatus comprising a three dimensional structure assembled from a plurality of interconnectable and disengageable construction elements, characterised in that each construction element is a shaped elongate body piece with two end mating faces or surfaces, each mating face having a connector to enable each construction element to connect to and disengage other like construction elements, and wherein the interconnection between two mating faces or surfaces is allowable in one orientation only and wherein the two connectors of each piece are transposed 180 degrees relative to each other, wherein the apparatus further comprises a minimum of two to four core elongate body pieces that create Celtic knotwork or weaving patterns in a three dimensional general plane, the four being; a straight (0 degrees) piece (A), a quadrant (90 degrees) piece (B), a U-bend (180 degrees) piece (C) and a loop (270 degrees) piece (D) as viewed from above, the front or side; where each piece has a side profile resembling a "stretched out half a sine wave/curve" which is stretched around each top profile in the three dimensional structure, the distance the side profile of a drop being equivalent to the diameter of the piece.

2. An apparatus for playing a game as claimed in claim 1, in which the elongate body pieces are interconnectable using an underlying grid of imaginary squares and lattices on which the pieces are orientated with each of the squares' edges being bisected, and these points are then joined to form a smaller square, rotated at 45 degrees, within the large square, with the straight pieces (A) using one of the small square edges, the quadrant pieces (B) using two small square edges, the u-bend pieces (C) using three small square edges and the loop pieces (D) using all four small square edges.

3. An apparatus for playing a game as claimed in claim 2, in which the interconnected pieces produce knots weaving under and over each other creating a three dimensional structure in one single or general plane (as defined), fifth and sixth pieces (Y's and Z's) are used in the transitions between planes which are folded through 90 degrees along the edges of the large underlying grid of imaginary squares, seventh and eighth pieces (T's and U's) are used in the transitions between planes which are folded through 90 degrees along the edges of the small underlying grid of imaginary squares, with many more complex and interesting knots being possible to be made with the said folded pieces, such as cubes and the like, including transitions using angles other than 90 degrees.

4. An apparatus for playing a game as claimed in claim 1, in which as default, all the pieces, with the exception of the straight pieces (A) bend in a clockwise direction as viewed from above, starting from the highest end, and ending at the lower position as the strand appears to go under another two joined pieces, where anti-clockwise bends are used, the pieces being marked to indicate that they bend in an anti-clockwise direction, whereby it is possible to mix clockwise and anti-clockwise pieces in the same three dimensional structure, with the possibility of clockwise and anti-clockwise pieces being reversed.

5. An apparatus for playing a game as claimed in claim 1, in which a push element having a mating surface, a receiving orifice, a flat surface and a locating notch is used to blank off one end of a piece, whereby a player can only add more pieces to the remaining unconnected end of the said piece.

6. An apparatus for playing a game as claimed in claim 1, in which two or more of the pieces are permanently connected or integrally formed with others to provide longer sections having connectors at each end.

7. An apparatus for playing a game as claimed in claim 1, in which each piece has one male connector at one end and a complementary shaped receiving orifice at the other end, the male connector being fitted in one orientation into a complementary shaped receiving orifice with the complementary orifice being transposed 180 degrees relative to the orientation of the male connector.

8. An apparatus for playing a game as claimed in claim 7, in which the pieces fit male to female all the way round any desired pattern in a manner which forces the strands produced by connecting the pieces to undulate alternately up and down to produce 'knot' or 'woven' type patterns.

9. An apparatus for playing a game as claimed in claim 7, including a male piece (A+) having a male connector at each end and a separate female (A−) having a complementary shaped receiving orifice at each end whereby by connecting a male piece (A+) to a female piece (A−) results in the same connection as connecting two male/female pieces together so as to enable a user to correct mistakes or redirect strands of knots formed upon connection of said pieces and does not have to completely dismantle a knot.

10. An apparatus for playing a game as claimed in claim 9, in which each main piece has two female orifices, one at each end with a key in each orifice being always orientated in the same way to each end, there also being a locating notch or hemispherical channel in each mating surface which widens out as it reaches the underside of each end, this channel being used to house half of the barrel section of the male connector and enable it to flex so that other body pieces may be attached to it and alternatively, the hemispherical channels are parallel and do not widen out when rigid connectors are used.

11. An apparatus for playing a game as claimed in claim 10 including a separate male connector piece which comprises two double ended pairs of male connectors, the first pair of male connectors being used to connect with two complementary female orifices in two pieces, the second pair of male connectors being disposed through 90 degrees to the first, rotated through 180 degrees along its axis, then offset and joined with a barrel to the first, this second pair of male connectors also being used to connect with two corresponding female orifices in two pieces, whereby each male connector piece is operable to connect with up to two, three or four main pieces and hold them together in a structure.

12. An apparatus for playing a game as claimed in claim 1, in which the connectors may either be a push fit or a snap fit type only.

13. An apparatus for playing a game, the apparatus comprising a three dimensional structure assembled from a plurality of interconnectable and disengageable construction elements, characterised in that each construction element is a shaped elongate body piece with two end mating faces or surfaces, each mating face having a connector to enable each construction element to connect to and disengage other like construction elements, and wherein the interconnection between two mating faces or surfaces is allowable in one orientation only and wherein the two connectors of each piece are transposed 180 degrees relative to each other, wherein each piece has one male connector at one end and a complementary shaped receiving orifice at the other end, the male connector being fitted in one orientation into a complementary shaped receiving orifice with the complementary orifice being transposed 180 degrees relative to the orientation of the male connector.

* * * * *